United States Patent [19]

Skaggs et al.

[11] 4,346,379

[45] Aug. 24, 1982

[54] AC DRIVE SYSTEM FOR PLASMA DISPLAY PANELS

[75] Inventors: William G. Skaggs; John L. Curry, both of Colorado Springs, Colo.

[73] Assignee: NCR Corporation, Dayton, Ohio

[21] Appl. No.: 177,329

[22] Filed: Aug. 12, 1980

[51] Int. Cl.[3] ..... G09G 3/28

[52] U.S. Cl. ..... 340/778; 340/776; 315/169.4

[58] Field of Search ..... 340/777, 778, 776, 771; 315/169.4, 169.1

[56] References Cited

U.S. PATENT DOCUMENTS

| | | | |
|---|---|---|---|
| 3,588,597 | 6/1971 | Murley, Jr. | 340/778 |
| 3,761,897 | 9/1973 | Tech | 340/778 |
| 3,973,253 | 8/1976 | Criscimagna et al. | 340/778 |
| 4,027,196 | 5/1977 | Criscimagna et al. | 340/778 |
| 4,110,663 | 8/1978 | Miyazaki et al. | 340/778 |

*Primary Examiner*—Marshall M. Curtis
*Attorney, Agent, or Firm*—J. T. Cavender

[57] ABSTRACT

An improved drive scheme for a plasma display panel having a cell formed at the crossover point of each of the panel's column and segment electrodes and a control system for implementing this drive scheme. The drive scheme of the present invention comprises the simultaneous application of AC drive signals having positive and negative components to the column and segment electrodes associated with a designated cell of the panel. These drive signals are 180° out-of-phase and are arranged to produce across the designated cell a voltage swing of sufficient magnitude to produce a discharge therein. In one embodiment of the drive scheme, the positive and negative components of each drive signal are equal. In a second embodiment of the drive scheme, the positive and negative components of each drive signal are not equal.

The control system for implementing the drive scheme is comprised of a DC-to-AC converter for producing the AC drive signals, a driver circuit associated with each column electrode of the display panel and a driver circuit associated with each segment electrode of the display panel. Each of the column and segment driver circuits is operable to provide to its associated column or segment electrodes both of the components of its associated AC drive signal if it is selected or only one of the components of its associated drive signal if it is not selected. In this way, the positive and negative components of the AC drive signals are selectively applied to the panel's column and segment electrodes to produce a desired illumination pattern.

37 Claims, 21 Drawing Figures

56
18a
58
50
54
60
52
64
62
$V_{T2}$
31
$V_{T1}$
16
29
26
22
24
28
40
30
36
32
34
38

AC DRIVE SYSTEM FOR PLASMA DISPLAY PANELS

BACKGROUND OF THE INVENTION

This invention relates in general to plasma display panels and, in particular, to an AC control system for selectively energizing the discharge cells of such a panel.

Plasma display panels currently find widespread use in a number of different applications. An example of this type of display panel is shown and described in the U.S. Pat. to Coleman et al., No. 3,614,769, which is incorporated herein by reference.

This type of display panel is normally comprised of an outer enclosure which is formed by a front and a rear glass plate. The front and rear glass plates of the panel are maintained in a spaced apart relationship and are sealed together along their outer perimeter to provide a hollow inner chamber which is filled with an ionizable medium such as any one of, or a mixture of, the gases neon, argon, helium, kypton, xenon, hydrogen and nitrogen. Matrix addressability is incorporated into the panel by disposing a plurality of vertical electrodes (hereinafter referred to as "column electrodes") on one glass plate of the panel and a plurality of horizontal electrodes (hereinafter referred to as "segment electrodes") on the other glass plate of the panel. The column electrodes are disposed on the inner surface of one plate of the panel to form a parallel array which extends across the plate in a vertical direction. The segment electrodes, on the other hand, are disposed on the inner surface of the other plate of the panel to form a parallel array which extends across the plate in a horizontal direction. In this way, the column and segment electrodes are maintained in a generally orthogonal relationship wherein each column electrode crosses over each segment electrode and vice versa. The point where a column electrode crosses over a segment electrode is referred to as a "cell". In such a display panel, an insulating layer is also placed over the segment and column electrodes to electrically insulate them from the gas contained within the panel, thereby providing capacitive coupling between the electrodes and the gas.

A cell of the matrix is illuminated by applying a suitable electric potential between the segment and column electrodes which form the cell. The application of a suitable electric potential between these two electrodes of a cell causes a gas discharge to occur within the cell. This discharge produces sufficient illumination for use as a visual display. Through the selective application of a suitable electric potential to the column and segment electrodes of the panel, selected groups of cells can be illuminated to provide a visual display of letters, numbers and other characters.

Several different types of control systems for driving such a display panel are presently known. All of these control systems, however, basically fall into one of three categories. Control systems in the first category normally include a pair of driver circuits which cooperate to apply one half of the required voltage to the segment electrode associated with the cell to be illuminated and the other half of the voltage to the column electrode associated with the cell. The resultant voltage is sufficient to initiate a discharge within the discharge cell which is disposed between these two electrodes.

Control systems of the second type normally include a driver circuit for each segment and column electrode and a switching circuit for each segment and column electrode. The driver and switching circuits cooperate to illuminate a designated cell by alternately energizing the column and segment electrodes associated with the cell while the cell's other electrode is electrically coupled with ground. In this way, the voltage needed to initiate a discharge is initially applied, for example, to the column electrode associated with a designated cell while the segment electrode associated with the cell is grounded. Thereafter, the required voltage is applied to the segment electrode associated with the designated cell while the cell's column electrode is grounded. The drive scheme continues in this fashion until the cell is no longer designated for illumination.

The final category of control system typically includes driver circuitry for selectively providing a bipolar pulse wave to either the column or segment electrodes and switching circuitry for selectively coupling the other electrodes to ground. In this configuration, a discharge occurs within a designated cell whenever one of the electrodes associated with the cell is receiving the pulse wave while the other electrode associated with the cell is electrically coupled with ground. In particular, a discharge occurs each time the positive or negative component of the pulse wave obtains a voltage sufficient to cause a discharge to occur.

While these prior art control systems exhibit adequate operation, none of them has proved to be totally satisfactory from a manufacturing standpoint. In particular, all of the presently-available control systems require the use of transistors which are capable of handling high voltages and, as a result, cannot be formed by monolithic integrated circuits. Accordingly, the prior art control systems are difficult and expensive to manufacture. Another disadvantage associated with the control systems of the prior art is that they tend to be complex in design and operation.

SUMMARY OF THE INVENTION

The control system of the present invention implements a drive scheme which overcomes all of the foregoing disadvantages. The drive scheme of the present invention comprises the simultaneous application of AC drive signals having positive and negative components to the column and segment electrodes associated with a designated cell. The AC drive signal provided to the cell's column electrode is 180° out-of-phase with the AD drive signal provided to the cell's segment electrode. The simultaneous application of a first AC drive signal to the column electrode associated with a designated cell and of a second AC drive signal, which is 180° out-of-phase with the first AC drive signal, to the segment electrode associated with the designated cell produces across the designated cell a voltage swing which is sufficient to cause a discharge within the cell. This type of drive scheme serves to lower the voltage requirements on the various components of the control system to thereby allow the control circuitry to be realized by a monolithic integrated circuit.

The control system of the present invention includes a DC-to-AC converter with a secondary having two outputs which are 180° out of phase, a driver circuit associated with each column electrode and a driver circuit associated with each segment electrode. The DC-to-AC converter is arranged to produce at each output of the secondary a voltage signal having positive and negative components. All of the column driver circuits are operatively coupled with one of the outputs of the secondary while all of the segment driver circuits are operatively coupled with the other output of the secondary. The column and segment driver circuits are arranged to control discharge of the various cells which comprise the display matrix. In particular, each of the column and segment driver circuits is operable to provide to its associated electrode only one of the components of the voltage signal produced at its associated output of the secondary if it is not selected and to provide to its associated electrode a drive signal comprising both the positive and negative components of the voltage signal produced at its associated output of the secondary if it is selected.

A discharge within a particular cell of the display matrix is initiated by selecting the column and segment driver circuits which are associated with the cell's column and segment electrodes. The column and segment driver circuits respond to selection by providing to their associated electrodes the positive and negative components of the voltage signal produced at their associated outputs of the secondary. In this way, the selected column and segment driver circuits pass to their associated electrodes an AC drive signal corresponding to the voltage signal produced on their associated output of the secondary. The AC drive signals provided to the electrodes associated with the column and segment driver circuits are 180° out-of-phase and produce across the designated cell a voltage swing sufficient to produce a discharge therein.

In one embodiment of the drive scheme, the positive and negative components of the voltage signal produced at each output of the DC-to-AC converter are balanced. This drive scheme is hereinafter referred to as the balanced drive scheme. The positive and negative components of the voltage signal produced by each output of the DC-to-AC converter, however, can be unbalanced to implement a second drive scheme which is hereinafter referred to as the unbalanced drive scheme. In fact, use of an unbalanced voltage swing actually improves the operation of the display panel. In the unbalanced drive scheme, the positive components of the voltage signal produced at one output of the converter have an absolute value which is greater than the absolute value of the negative components of this voltage signal. The voltage signal produced by the other output of the converter, on the other hand, has negative components which obtain an absolute value greater than the absolute value of the positive components of this voltage signal. By using an unbalanced voltage swing, the half select voltage on an unselected cell is reduced, thereby reducing the chance of a spurious firing. Reduction of the half select voltage also increases the operating range of the display panel, thereby allowing the panel to tolerate more drift in the AC drive signals used to produce a discharge.

The unique design of the driver scheme implemented by the subject control system provides several advantages which were previously unavailable. In particular, the drive scheme of the subject invention greatly reduces the voltage requirements on the column and segment driver circuits, thereby allowing these circuits to be constructed of a monolithic integrated circuit. In addition, the use of a DC-to-AC converter eliminates the need for an internal clock, thereby simplifying the design of the control circuit. Use of this DC-to-AC converter also eliminates the need for a high voltage DC source, thereby providing a corresponding reduction in the amount of power consumed during operation of the panel. This reduction in power consumption produces a corresponding reduction in the cost of driving the plasma display panel. The driver scheme of the present invention also improves the operation of the display panel. By unbalancing the output voltage swing of the DC-to-AC converter, the half select voltage can be reduced, thereby increasing the operating range of the panel. An additional advantage of the subject drive scheme is that blanking can be incorporated into the control system to erase wall charge and thereby further improve the operating range of the display panel. This blanking feature is implemented by simply turning off the DC-to-AC converter of the control system. When the DC-to-AC converter is turned off, the voltage signals produced by each output of the converter decay for several cycles. This decay causes a corresponding erasure of the wall charge stored on any of the designated cells. This erasure of the stored wall charge increases the amount of half select voltage needed to cause a discharge of the cell and thereby improves the operating range of the display panel.

It is therefore an object of the present invention to provide a plasma display drive scheme which comprises the simultaneous application of a different AC drive signal to the column and segment electrodes associated with a designated cell.

Another object of the present invention is to provide a plasma display drive scheme, of the character described, which significantly reduces the peak voltage of the positive and negative components of the AC drive signals applied to the column and segment electrodes to thereby allow the control system to be constructed of a monolithic integrated circuit.

A further object of the present invention is to provide a plasma display drive scheme, of the character described, wherein the AC drive signals applied to the column and segment electrodes of the designated cell have an unbalanced voltage swing to thereby increase the operating range of the display panel.

It is yet another object of the present invention to provide a plasma display control system for selectively energizing the discharge cells of a plasma display panel which may be formed by a monolithic integrated circuit.

It is another object of the present invention to provide a plasma display control system of the character described, which includes a DC-to-AC converter that is capable of producing a pair of AC voltage signals having positive and negative components and column and segment driver circuits each of which is operable to provide to an attendant electrode the positive and negative components of its associated AC voltage signal if it is selected and to provide to its associated electrode only one of the components of its associated AC voltage signal if it is not selected.

It is an additional object of the present invention to provide a plasma display control system, of the character described, which is capable of erasing wall charge to thereby improve the operating range of the display panel.

The foregoing and additional objects, features and advantages will be apparent from the following description of the invention.

DETAILED DESCRIPTION OF THE INVENTION

Figure 1:
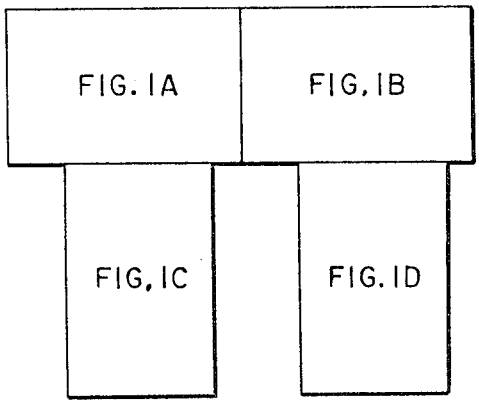
FIG. 1 is a plot showing how FIGS. 1A, B, C and D are to be arranged for proper viewing.
Figure 4:
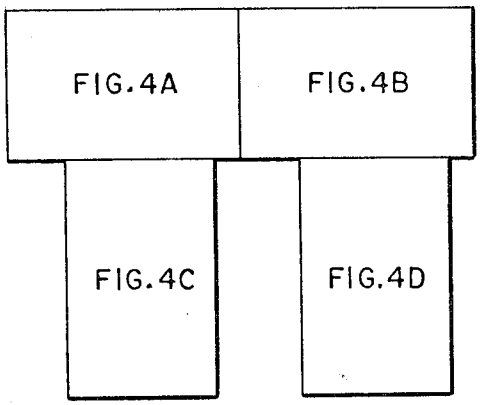
FIG. 4 is a plot showing how FIGS. 4A, B, C and D are to be arranged for proper viewing.
Figure 1A:
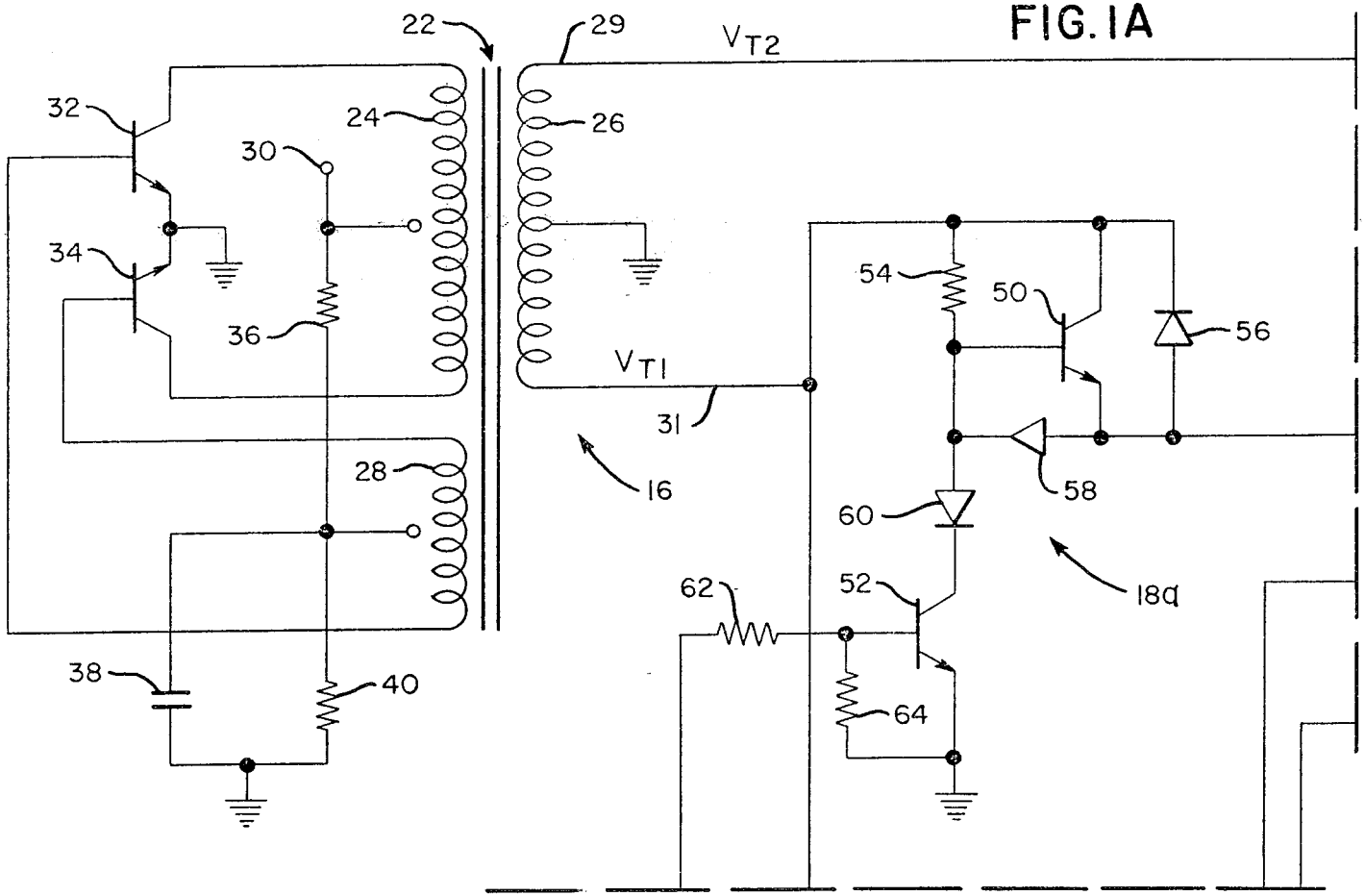
FIGS. 1A, B, C and D together comprise a detailed schematic diagram of a first control system for implementing the balanced drive scheme of the present invention.
Figure 1B:
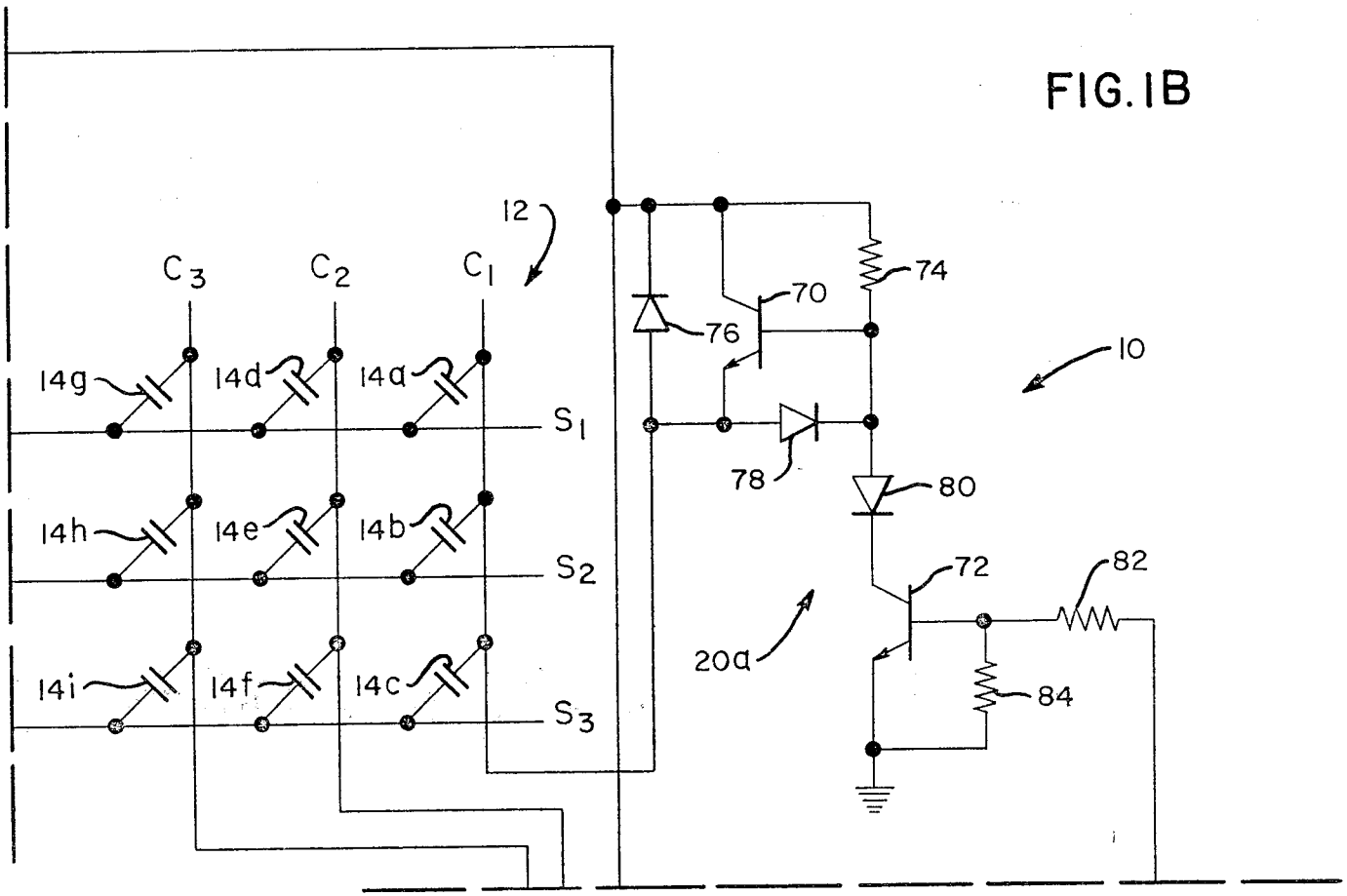

Reference is now made to FIGS. 1A, B, C and D wherein a control system for implementing the balanced drive scheme of the present invention is generally designated by the numeral 10. The control system 10 shown in FIGS. 1A–D is arranged to drive a conventional plasma display panel which is generally designated by the numeral 12 (FIG. 1B). Plasma display panel 12 is of a conventional design which is well-known to those of ordinary skill in the art and thus, will be shown only as necessary in describing the present invention. In particular, the display panel is comprised of an outer enclosure which is formed by a pair of glass plates. The glass plates are maintained in a spaced-apart parallel relationship and are sealed together along their outer perimeter to provide a hollow inner chamber. The hollow inner chamber of the panel is in turn filled with an ionizable medium such as any one of, or a mixture of, the gases neon, argon, helium, kypton, xenon, hydrogen and nitrogen. A first plurality of electrodes (hereinafter referred to as segment electrodes) $S_1$, $S_2$ and $S_3$ are disposed on one glass plate of the panel in a parallel relationship. These electrodes are insulated from the ionizable medium contained within the hollow inner chamber and form a parallel array of electrodes which extend across the surface of the plate in the X direction. A second group of parallel electrodes (hereinafter referred to as column electrodes) $C_1$, $C_2$ and $C_3$ are disposed on the other glass plate of the panel and are likewise insulated from the ionizable medium contained therein. The column electrodes $C_1$, $C_2$ and $C_3$ form a parallel array of electrodes which extend across the glass plate on which they are disposed in the Y direction. The segment and column electrodes are generally orthogonal to each other and cross over each other at a plurality of points referred to as cells. Nine such cells are shown in FIG. 1 and are designated by the numerals 14a–i. For simplicity, each of these cells is represented in FIG. 1 as a single capacitor having one of its plates coupled with a particular column electrode and its other plate coupled with a particular segment electrode.

It should be emphasized at this time that the number of column electrodes, segment electrodes and cells is only illustrative and should not be interpreted in a limiting sense. In fact, the number of column electrodes, segment electrodes and cells can be readily expanded or decreased to provide a display panel of any desired size. For a more detailed description of a display panel suitable for use in combination with the control circuit of the present invention, reference is made to U.S. Pat. No. 3,704,052, issued to Coleman and entitled METHOD OF MAKING A PLASMA DISPLAY PANEL.

The control system 10 shown in FIGS. 1A–D is basically comprised of a Royer oscillator 16 (FIG. 1A) for producing a pair of AC voltage signals having positive and negative components, a plurality of segment drivers 18*a*, 18*b* (FIG. 1C) and 18*c* for selectively controlling the application of drive signals to the various segment electrodes of plasma display panel 12, and a plurality of column drivers 20*a*, 20*b* and 20*c* (FIGS. 1B and 1D) for selectively controlling the application of drive signals to the various column electrodes of display panel 12. Oscillator 16 is of a conventional design and includes a transformer 22 having a primary coil 24, a secondary coil 26 and a tertiary coil 28. The primary coil 24 of transformer 22 is equipped with a center tap which is in turn electrically coupled with a power input 30. One end of primary coil 24 is electrically coupled with the collector electrode of a first switching transistor 32 while the other end of the coil is electrically coupled with the collector electrode of a second switching transistor 34. The emitter electrode of switching transistor 32 and the emitter electrode of switching transistor 34 are both coupled with system ground. The base electrode of switching transistor 32 is in turn electrically coupled with one end of tertiary coil 28 while the base electrode of switching transistor 34 is electrically coupled with the other end of this coil. Tertiary coil 28 is provided with a center tap which is electrically coupled with power input 30 through a resistor 36 and with system ground through an RC network comprised of a capacitor 38 and a resistor 40. Secondary winding 26 is provided with a center tap which is electrically coupled with system ground and is arranged to have an upper end which comprises one output of Royer oscillator 16 and a lower end which comprises the other output of the oscillator. The output of oscillator 16 which is formed by the upper end of secondary winding 26 is designated by the numeral 29 while the output of the oscillator which is formed by the lower end of the secondary coil is designated by the numeral 31.

As mentioned above, the control circuit shown in FIGS. 1A–D is equipped with three segment driver circuits which are generally designated by the numerals 18*a*, 18*b* and 18*c*. Each of the segment driver circuits 18*a*, 18 *b* and 18*c* is arranged to control the application of drive signals to a different segment electrode in response to a control signal from an attendant serial input/parallel output buffer 42. In particular, segment driver circuit 18*a* is associated with segment electrode $S_1$ while segment driver circuits 18*b* and 18*c* are associated with segment electrodes $S_2$ and $S_3$, respectively. All of the segment driver circuits are operatively coupled with output 31 of Royer oscillator 16 to receive the AC voltage signal produced at this output of the oscillator.

Buffer 42 is a conventional item which is well-known to those of ordinary skill in the art. This buffer is provided with a serial data input 44 for receiving serial data from an external source, (not shown herein) a clock input 45 for receiving clock pulses from an external source (not shown herein) and a plurality of outputs $D_0$-$D_2$ for providing a plurality of control signals which are generated in accordance with the received data.

Each of the outputs $D_0$-$D_2$ is operatively coupled with a different segment driver circuit to control the application of drive signals to the driver circuit's associated segment electrode. As shown in FIGS. 1A–D the $D_0$ output of buffer 42 is operatively coupled with segment driver circuit 18*a* while the $D_1$ and $D_2$ outputs of the buffer are operatively coupled with segment drivers 18*b* and 18*c*, respectively.

Since each of the segment driver circuits 18*a*, 18*b* and 18*c* is identical in design, construction and operation, only segment driver circuit 18*a* will be described in detail herein. As shown herein, segment driver circuit 18*a* is comprised of a pair of bipolar transistors 50 and 52. The collector electrode of transistor 50 is coupled directly with output 31 of oscillator 16 while the base electrode of this transistor is electrically coupled with this output through a resistor 54. The emitter electrode of transistor 50 is in turn electrically coupled with the driver circuit's associated segment electrode $S_1$. The segment electrode $S_1$ is also connected with the anode of a diode 56 and with the anode of a second diode 58. The cathode of diode 56 is in turn electrically coupled with the collector electrode of transistor 50 and with output 31 of oscillator 16. The cathode of diode 58, on the other hand, is simultaneously coupled with the base electrode of transistor 50 and with the collector electrode of transistor 52 through a third diode 60. In this way, diodes 58 and 60 are arranged to isolate switching transistor 52 from excessive voltage swings. The base electrode of transistor 52 is in turn coupled with the $D_0$ output of buffer 42 through a resistor 62 and with system ground through a resistor 64. The emitter electrode of this transistor is in turn coupled directly with system ground.

The control system shown in FIGS. 1A–D is also equipped with three column driver circuits which are generally designated by the numerals 20*a*, 20*b* and 20*c*. Each of the column driver circuits 20*a*, 20*b* and 20*c* is arranged to control the application of drive signals to one of the column electrodes $C_1$, $C_2$ and $C_3$ in response to a select signal from multiplexing circuit 66. In particular, column driver circuit 20*a* is arranged to control the application of drive signals to column electrode $C_1$ while column driver circuits 20*b* and 20*c* are arranged to selectively apply drive signals to column electrodes $C_2$ and $C_3$, respectively. In addition, all of the column driver circuits are operatively coupled with output 29 of Royer oscillator 16 to receive the AC voltage signal produced at this output of the oscillator.

Multiplexing circuit 66 is provided with a plurality of inputs $I_1$, $I_2$ and $I_3$ for receiving a binary column address from an external source (not shown herein) and a plurality of outputs $Y_0$, $Y_1$ and $Y_2$ for applying select signals to the column driver circuits. Each of the outputs $Y_0$, $Y_1$ and $Y_2$ of column selector 66 is in turn operatively coupled with one of the column driver circuits. In particular, output $Y_0$ is operatively coupled with column driver 20*a* while outputs $Y_1$ and $Y_2$ are operatively coupled with column drivers 20*b* and 20*c*, respectively.

All of the column driver circuits are identical in design and construction. Accordingly, only column driver circuit 20*a* will be described in detail herein. Column driver circuit 20*a* is similar in design and construction to the segment driver circuit 18*a* and includes a pair of bipolar transistors 70 and 72. As shown in FIG. 1, the collector electrode of transistor 70 is connected directly with output 29 of oscillator 16 while its base electrode is coupled with the output of the oscillator through a resistor 74. The emitter electrode of transistor 70 is in turn electrically coupled with its associated column electrode $C_1$ and with the anodes of a pair of diodes 76 and 78. Diode 76 has its cathode electrically coupled with the collector electrode of transistor 70 while diode 78 has its cathode electrically coupled with the base electrode of transistor 70 and with the anode of a third diode 80. The cathode of diode 80 is in turn electrically coupled with the collector electrode of transistor 72. The emitter electrode of transistor 72 is electrically coupled with system ground while the base electrode of this transistor is electrically coupled with the $Y_0$ output of column selector 66 through a resistor 82 and with system ground through a resistor 84.

In operation, the application of a DC voltage signal to power input 30 of oscillator 16 causes the oscillator to produce a pair of AC voltage signals $V_{T1}$ and $V_{T2}$. Voltage signal $V_{T1}$ is produced at the output 31 of oscillator 16 while voltage signal $V_{T2}$ is produced at output 29 of the oscillator. Voltage signals $V_{T1}$ and $V_{T2}$ are produced at their respective outputs of the oscillator 180° out-of-phase so that a positive component of voltage signal $V_{T1}$ is present at output 31 while a negative component of voltage signal $V_{T2}$ is present at output 29 and vice versa. A segmatic illustration of these two voltage signals is given in lines I and II of FIG. 2A.

Figure 1C:
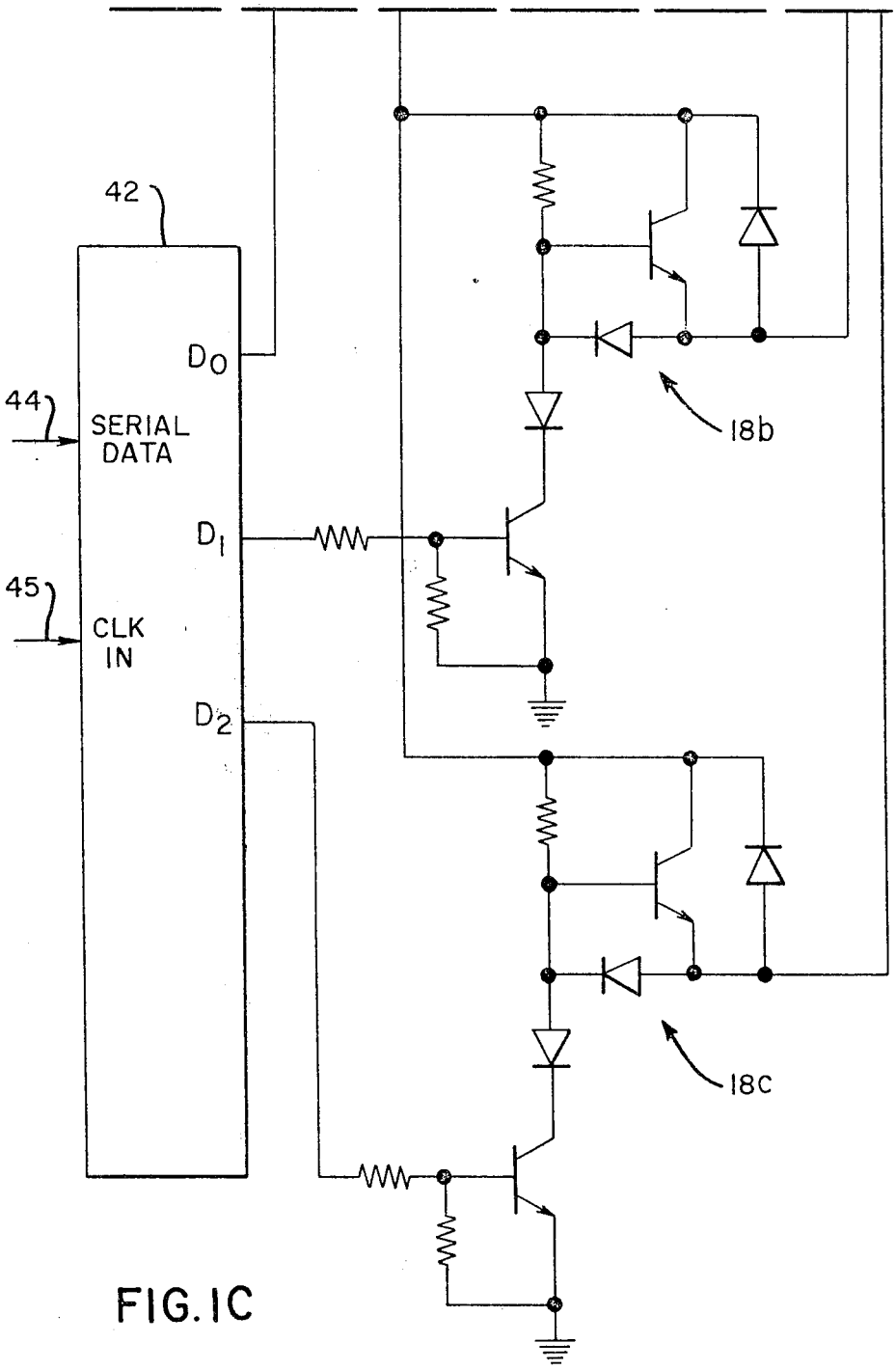
Figure 1D:
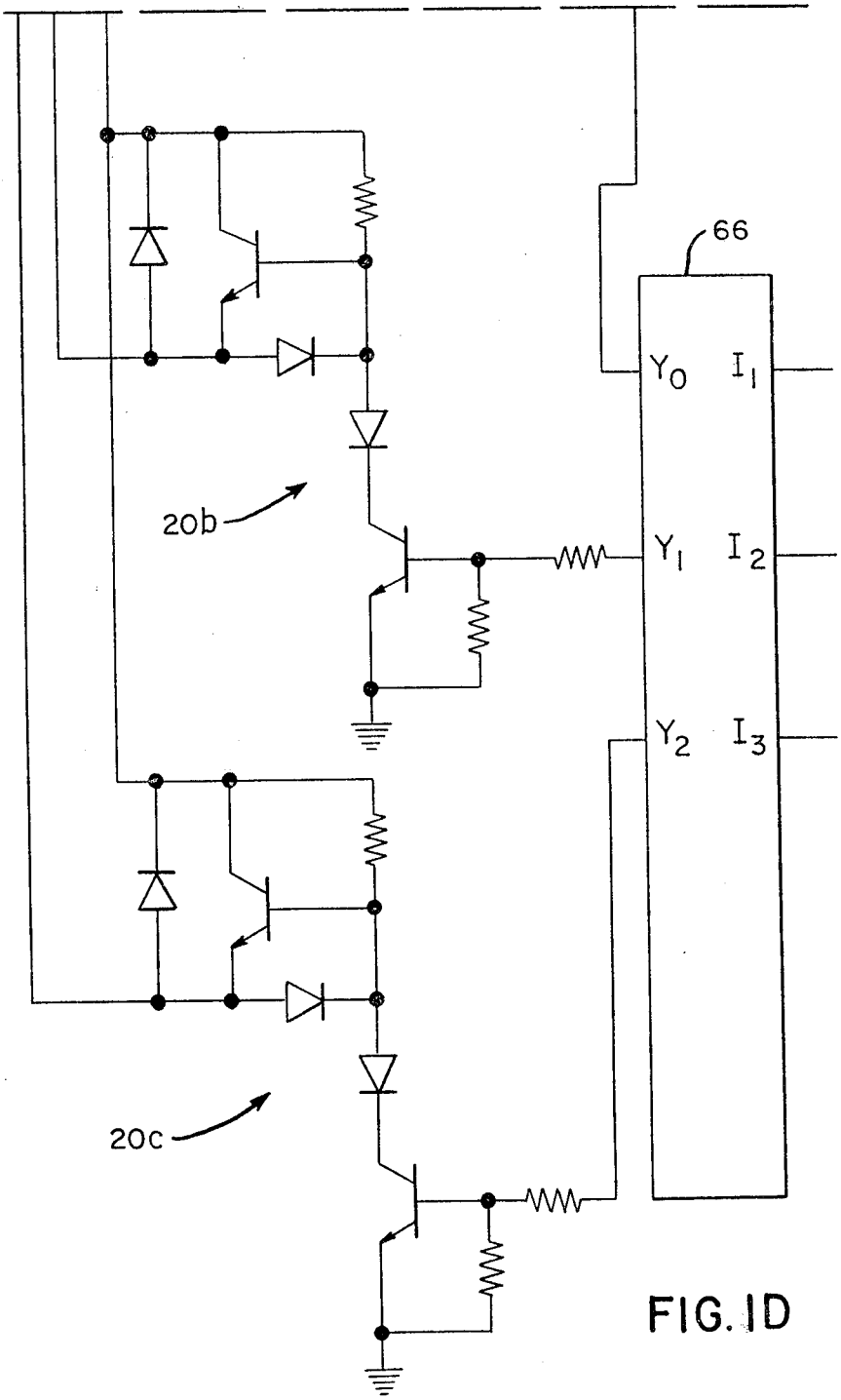
Figure 2A:
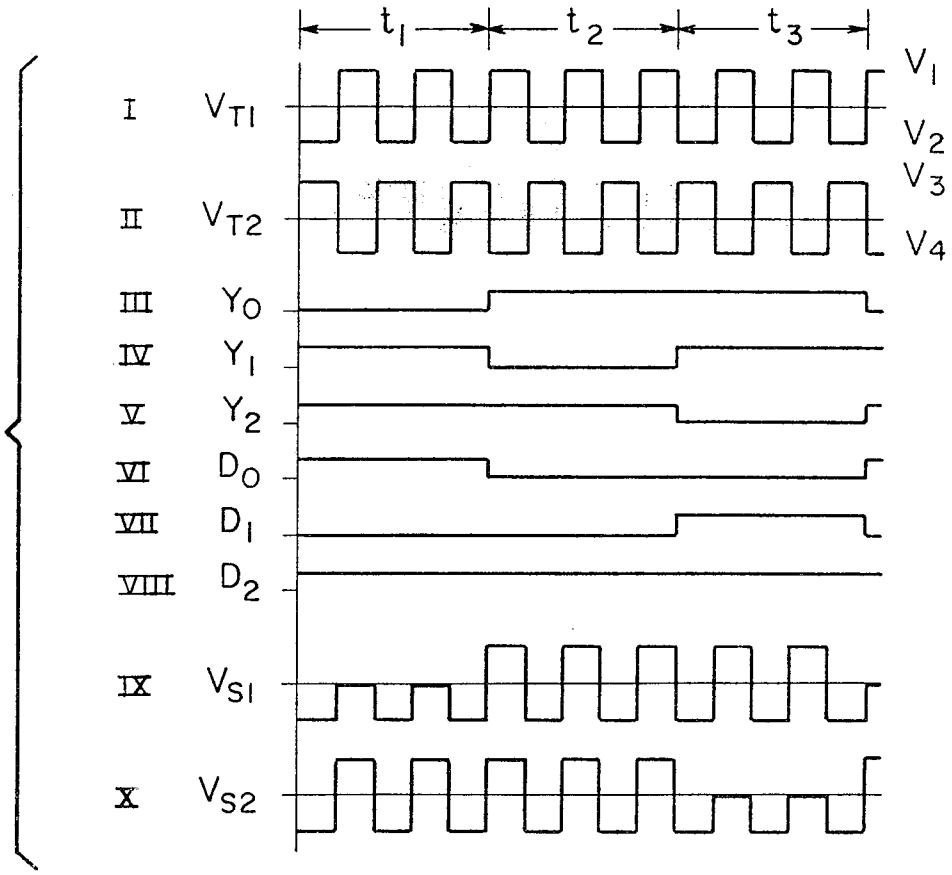
FIGS. 2A, B, C and D show a plurality of waveforms illustrating the operation of the circuit shown in FIG. 1.

As shown in lines I and II of FIG. 2A, the voltage signal $V_{T1}$ is periodically varied between a predetermined positive voltage $V_1$ and a predetermined negative voltage $V_2$ with the absolute value of the positive voltage being equal to the absolute value of the negative voltage. Similarly, the voltage signal $V_{T2}$ is arranged to periodically vary between a predetermined positive voltage $V_3$ and a predetermined negative voltage $V_4$. As with voltage signal $V_{T1}$, the absolute value of the positive component of voltage signal $V_{T2}$ is equal to the absolute value of the negative component. Additionally, the positive voltage $V_1$ which marks the upper boundary of voltage signal $V_{T1}$ is equal to the positive voltage $V_3$ which marks the upper boundary of voltage signal $V_{T2}$. Similarly, the peak negative voltage $V_2$ of voltage signal $V_{T1}$ is equal to the peak negative voltage $V_4$ of voltage signal $V_{T2}$. The positive and negative voltage limits of voltage signals $V_{T1}$ and $V_{T2}$ are selected by experimentally determining the firing voltage $V_{fire}$. The firing voltage $V_F$ is the lowest voltage which causes all of the cells of the display panel to ignite when the cells are subjected to a sequence of alternating voltage pulses. The experimentally determined firing voltage is divided by four to obtain the required value for the positive and negative components of voltage signals $V_{T1}$ and $V_{T2}$ for the balanced circuit of FIGS. 1A–D. In particular, the absolute value of the positive and negative components of voltage signals $V_{T1}$ and $V_{T2}$ are made equal to the voltage derived by dividing the firing voltage by four. Once the desired voltage swing is computed, the components of oscillator 16 are chosen to provide the desired positive and negative voltages. In particular, the positive and negative voltages are established by varying the turns ratio between primary coil 24 and secondary coil 26 to produce the desired voltage swing.

Voltage signal $V_{T1}$ is simultaneously provided to each of the segment driver circuits 18*a*, 18*b* and 18*c*. Voltage signal $V_{T2}$, on the other hand, is simultaneously provided to each of the column driver circuits 20*a*, 20*b* and 20*c*. Each of the segment driver circuits 18*a*, 18*b* and 18*c* is selectively operable to pass to its respective segment electrode only the negative components of voltage signal $V_{T1}$ if the driver circuit is not selected or to pass to its respective segment electrode both the positive and negative components of voltage signal $V_{T1}$ if the driver circuit is selected. The column driver circuits 20*a*, 20*b* and 20*c* operate in a similar manner. In particular, each of the column driver circuits 20*a*, 20*b* and 20*c* is selectively operable to pass to its respective column electrode only the negative components of voltage signal $V_{T2}$ if the driver circuit is not selected or to pass to its respective column electrode both the positive and negative components of voltage signal $V_{T2}$ if the driver circuit is selected. Accordingly, selection of a particular column or segment driver circuit causes a drive signal comprising the positive and negative components of the electrode's corresponding voltage signal ($V_{T1}$ or $V_{T2}$) to be applied to its associated column or segment electrode. Selection of the column driver circuits is controlled as mentioned above, by multiplexing circuit 66 while selection of the segment driver circuits is controlled by the serial input/parallel output buffer 42.

Multiplexing circuit 66 is a conventional circuit device which is operable to select one of the column driver circuits 20*a*, 20*b* and 20*c* in response to the binary column address applied to inputs $I_0$, $I_1$ and $I_2$ of the circuit. Selection of a particular column driver circuit is accomplished by providing a binary column address corresponding to the column driver circuit to be activated. Multiplexing circuit 66 responds to this address by providing a low level logic signal (referred to herein as a select signal) at the output associated with the column driver circuit designated by the received address. As a result, the multiplexing circuit 66 is arranged to provide a high level logic signal at each of the outputs associated with an unselected column driver circuit when the plasma display panel is in operation. A low level logic signal, however, is provided by multiplexing circuit 66 at the output associated with a designated column driver circuit.

In normal operation, the multiplexing circuit 66 is addressed to select each of the column driver circuits 20*a*, 20*b* and 20*c* in a continuously repeating sequence. Accordingly, a regularly repeating sequence of select signals is produced at the $Y_0$, $Y_1$ and $Y_2$ outputs of the multiplexing circuit 66 during normal operation of the display panel. This regularly operating sequence of select signals is shown in lines III–V of FIG. 2A. As shown in lines III–V of FIG. 2A, the $Y_0$ output of multiplexing circuit 66 is pulsed to a low level logic state to select column driver circuit 20*a* during time period $t_1$. During the next time period $t_2$, the $Y_0$ output of multiplexing circuit 66 is returned to a high level logic state and the $Y_1$ output of the circuit is pulsed to a low level logic state. The $Y_1$ output of multiplexing circuit 66 remains at a low level logic state until time period $t_3$. During time period $t_3$, the $Y_1$ output of multiplexing circuit 66 returns to a high level logic state and the $Y_2$ output is placed at a low level logic state. The $Y_2$ output of multiplexing circuit 66 is returned to a high level logic state upon termination of time period $t_3$. Upon completion of time period $t_3$, all of the column driver circuits have been selected and, as a result, the above described pattern is repeated by designating that the $Y_0$ output of multiplexing circuit 66 be placed at a low level logic state as shown in time period $t_1$.

For a more detailed description of the operation of the column driver circuits, reference is now made to column driver circuit 20*a* (FIG. 1B). When this circuit's associated output $Y_0$ of multiplexing circuit 66 is at a high level logic state, the positive components of voltage signal $V_{T2}$ are not passed to the column electrode $C_1$. In particular, the presence of a high level logic signal at output $Y_0$ causes transistor 72 to be placed in a saturated condition thereby providing a conduction path between its emitter and collector electrodes. When transistor 72 is in this condition, the positive components of voltage signal $V_{T2}$ are not passed through transistor 70 to column electrode $C_1$ because the base drive current flowing through resistor 74 is passed to ground through diode 80 and transistor 70. The negative component of voltage signal $V_{T2}$, however, produces a somewhat different action within column driver circuit 20*a*. In the period when voltage signal $V_{T2}$ is at a negative voltage, transistor 70 is cut off but diode 76 serves to connect column electrode $C_1$ with output 29 of oscillator 16. Diode 78, on the other hand, is maintained in a non-conducting state and, as a result, serves to isolate the negative component of voltage signal $V_{T2}$ from system ground. Accordingly, the negative components of voltage signal $V_{T2}$ are applied to column electrode $C_1$ via diode 76 regardless of the logic condition of the $Y_0$ output of multiplexing circuit 66.

When the $Y_0$ output of multiplexing circuit 66 is placed in a low level logic condition in response to column driver circuit 20*a* being selected, the driver circuit operates to apply both the negative and positive components of voltage signal $V_{T2}$ to column electrode $C_1$. In particular, transistor 72 is cut off whenever output $Y_0$ of multiplexing circuit 66 is at a low level logic state. When transistor 72 is cut off, the positive components of voltage signal $V_{T2}$ are applied to column electrode $C_1$. In addition, the negative components of the voltage signal $V_{T2}$ are still applied to column electrode $C_1$ as described above.

All of the column driver circuits operate in the same manner. Accordingly, each of the column driver circuits 20*a*, 20*b* and 20*c* is capable of providing to its associated column electrode only the negative components of voltage signal $V_{T2}$ when the driver circuit is not selected and the positive and negative components of voltage signal $V_{T2}$ when the driver circuit is selected. As mentioned above, each of the column driver circuits is normally selected in a set succession. It has been assumed for the purposes of this discussion that the selection cycle is arranged so that column driver circuit 20*a* is selected during time period $t_1$ while column driver circuits 20*b* and 20*c* are selected during time periods $t_2$ and $t_3$, respectively. Accordingly, the positive and negative components of voltage signal $V_{T2}$ are applied to column electrode $C_1$ during time period $t_1$ while components of voltage signal $V_{T2}$ are applied to column electrodes $C_2$ and $C_3$ during time periods $t_2$ and $t_3$, respectively. During the other periods, only the negative components of voltage signal $V_{T2}$ are applied to these electrodes. This operation is shown in lines XII–XIV of FIG. 2B.

Selection of the segment driver circuits 18*a*, 18*b* and 18*c* is controlled by buffer 42 (FIG. 1C). Buffer 42 is operable to produce select signals at its various outputs $D_0$, $D_1$ and $D_2$ in response to serial data provided to the buffer via serial data input 44 and clock pulses provided to the buffer from an external source via clock-in input 70. Buffer 42 responds to the serial data and clock pulses by providing at its various outputs the combination of select signals needed to illuminate the designated combination of cells which are attached to the column electrode associated with the presently selected column driver circuit. It should be noted that the application of clock pulses to buffer 42 is synchronized relative to the application of address codes to multiplexing circuit 66. In particular, a clock pulse is provided to buffer 42 in unison with the application of a binary column address code to multiplexing circuit 66 to synchronize the selection of the segment and column electrodes.

Selection of a particular segment driver circuit is accomplished by producing a low level logic signal at the output associated with this driver circuit. As a result, buffer 42 is operable to maintain each output corresponding to an unselected driver circuit at a high level logic signal and to provide a low level logic signal at each output corresponding to a selected driver circuit.

The operation of the segment driver circuits 18*a*, 18*b* and 18*c* is the same as the operation of the column driver circuits 20*a*, 20*b* and 20*c* described above. In particular, the presence of a low level logic signal on the input of one of the segment driver circuits 18*a*, 18*b* or 18*c* causes the corresponding driver circuit to provide the positive and negative components of voltage signal $V_{T1}$ to the circuit's associated segment electrode. Each of the segment driver circuits, however, responds to a high level logic signal at its associated output of buffer 42 by providing only the negative components of voltage signal $V_{T1}$ to its associated segment electrode.

Reference is now made to segment driver circuit 18*a* (FIG. 1A) for a more detailed description of the operation of the segment driver circuits. The presence of a high level logic signal at output $D_0$ of buffer 42 (FIG. 1C) causes transistor 52 to be maintained in a saturated condition, thereby providing a conduction path between the collector and emitter electrodes of this transistor. In this condition, the segment electrode $S_1$ (FIG. 1B) is held at ground during the positive transitions of $V_{T1}$. In particular, the receipt of a positive component of voltage signal $V_{T1}$ causes transistor 50 to be cut off, thereby allowing the positive component of the voltage signal to be dropped across the collector-emitter junction of this transistor. As a result of this action, segment electrode $S_1$ is held at system ground through diodes 58 and 60 and transistor 52. While transistor 50 is not placed in a saturated condition upon receipt of the negative components of voltage signal $V_{T1}$, receipt of the negative components does place diode 56 in a conductive state thereby providing a conduction path between segment electrode $S_1$ and output 31 of oscillator 16 through diode 56. In addition, diode 60 serves to isolate the negative components of voltage signal $V_{T1}$ from system ground and, as a result, the negative components of this voltage signal are applied to signal electrode $S_1$ regardless of the logic condition of output $D_0$ of buffer 42.

The presence of a low level logic signal at output $D_0$ of buffer 42, on the other hand, causes segment driver circuit 18*a* to provide to its associated segment electrode $S_1$ both the positive and negative components of voltage signal $V_{T1}$. In particular, the negative components of voltage signal $V_{T1}$ are applied to segment electrode $S_1$ through diode 56 as described above. The positive components of $V_{T1}$ are conducted through transistor 50 which is conductive. These components are then applied to segment electrode $S_1$ rather than to system ground because the presence of a low level logic signal at output $D_0$ places transistor 52 in a cutoff condition. Accordingly, both the positive and negative components of voltage signal $V_{T1}$ are applied to segment electrode $S_1$ when segment driver circuit 18*a* is selected by providing a low level logic signal at output $D_0$ of buffer 42.

For the purposes of discussion, it is assumed that the received serial data indicates that cells 14*b*, 14*d*, 14*e* and 14*g* are to be illuminated. In order to illuminate the cell 14*b*, a drive signal comprising the positive and negative components of voltage signal $V_{T2}$ must be applied to column electrode $C_1$ at the same time as a drive signal comprising the positive and negative components of voltage signal $V_{T1}$ is applied to segment electrode $S_2$. Similarly, illumination of cells 14*d* and 14*e* is accomplished by applying a drive signal comprising the positive and negative components of voltage signal $V_{T1}$ to segment electrodes $S_1$ and $S_2$ coincident with the application of a drive signal comprising the positive and negative components of voltage signal $V_{T2}$ to column electrode $C_2$. Finally, cell 14*g* is illuminated by providing a drive signal comprising the positive and negative components of voltage signal $V_{T1}$ to segment electrode $S_1$ while a drive signal comprising the positive and negative components of voltage signal $V_{T2}$ is being applied to column electrode $C_3$. Accordingly, segment driver circuit 18*a* must be selected by buffer 42 coincident with the selection of column driver circuits 20*b* and 20*c* by multiplexing circuit 66 and segment driver circuit 18*b* must be selected by buffer 42 coincident with the selection of column driver circuits 20*a* and 20*b* by multiplexing circuit 66 in order to effectuate the desired illumination pattern.

As shown in lines VI–VIII of FIG. 2A, the above-mentioned illumination pattern is implemented by placing the $D_0$ output of buffer 42 at a low level logic state during time periods $t_2$ and $t_3$ and the $D_1$ output of buffer 42 at a low level logic state during time periods $t_1$ and $t_2$. The waveforms present on segment electrodes $S_1$, $S_2$ and $S_3$ as a result of this selection pattern are shown in lines IX–XI of FIGS. 2A and B. As shown in line IX of FIG. 2A, a drive signal comprising the positive and negative components of voltage signal $V_{T1}$ is present on segment electrode $S_1$ during time periods $t_2$ and $t_3$ while only the negative components of this voltage signal are present on segment electrode $S_1$ during time period $t_1$. As shown in line X of FIG. 2A, the above-mentioned illumination pattern causes a drive signal comprising the positive and negative components of voltage signal $V_{T1}$ to be present on segment electrode $S_2$ during time periods $t_1$ and $t_2$ while only the negative components of this voltage signal are present on segment electrode $S_2$ during time period $t_3$. Since segment driver circuit 18*c* is not selected during any of the time periods $t_1$, $t_2$ and $t_3$, only the negative components of voltage signal $V_{T1}$ are applied to segment electrode $S_3$ during these time periods. This voltage waveform is shown in line XI of FIG. 2B. As a result of this action, drive signals are present on column electrode $C_1$ and segment electrode $S_1$ during time period $t_1$, on column electrode $C_2$ and segment electrodes $S_1$ and $S_2$ during time period $t_2$ and on column electrode $C_3$ and segment electrode $S_2$ during time period $t_3$. Accordingly, cell 14*b* is illuminated during time period $t_1$. Cells 14*d* and 14*e* are additionally illuminated during time period $t_2$ while cell 14*g* is illuminated during time period $t_3$.

As mentioned above, the simultaneous application of a drive signal to the column and segment electrodes associated with a designated cell causes the designated cell to be illuminated. In particular, the simultaneous application of a drive signal to the column and segment electrodes associated with a designated cell produces across the designated cell a full select voltage swing which is equal to the sum of the voltage swings of the voltage signals $V_{T1}$ and $V_{T2}$. In other words, the actual pulse height applied across the designated cell is equal to the sum of the positive voltages $V_1$ and $V_3$ which respectively mark the upper boundaries of voltage signals $V_{T1}$ and $V_{T2}$ plus the sum of the absolute values of the negative voltages $V_2$ and $V_4$ which respectively mark the lower boundaries of voltage signals $T_{T1}$ and $V_{T2}$. The magnitude of the full select voltage swing $V_F$ is defined by the following equation:

$$V_F = V_1 + |V_2| + V_3 + |V_4| > V_{fire}$$

where $V_{fire}$ is the lowest voltage which causes all of the cells of the display panel to ignite when they are subjected to a sequence of alternating voltage pulses.

The application of a drive signal to only one of the electrodes associated with a cell applies a half select voltage to the cell. In this case, the cell is connected to either a column or segment electrode which is receiving both the positive and negative components of its associated voltage signal while the other electrode is receiving only the negative components of its associated voltage signal. The magnitude of the half select voltage swing is given by one of the following equations:

$$V_{half\ select} = V_1 + |V_2| + |V_4| < V_{min}; \text{ or}$$

$$V_{half\ select} = |V_2| + V_3 + |V_4''| < V_{min}.$$

In order to prevent spurious firing, the half select voltage $V_{half\ select}$ must be less than the lowest voltage needed to fire any cell of the panel (designated $V_{min.}$) when a sequence of alternating voltage pulses is applied to the cell.

If a drive signal is not applied to either of the electrodes associated with a cell, an unselected voltage swing is applied across the cell. The magnitude of this voltage swing is equal to the sum of the absolute value of the negative component $V_2$ of voltage signal $V_{T1}$ and the absolute value of the negative component $V_4$ of voltage signal $V_{T2}$ and is given by the equation;

$$|V_2| + |V_4| = V_{unselected}.$$

As mentioned above, the magnitude of the positive and negative components of voltage signals $V_{T1}$ and $V_{T2}$ is determined by dividing the firing voltage by four. Since the absolute value of the positive and negative voltages of the voltage signals $V_{T1}$ and $V_{T2}$ are all equal, these voltages are all set equal to the voltage obtained by dividing the firing voltage by four. The positive and negative voltages which are established through this technique also provide a half select voltage which is small enough to prevent spurious firing of an unselected cell.

In conventional plasma display panels, typical values of $V_{fire}$ and $V_{min}$ are 220 volts and 180 volts, respectively. To effectively drive such a display panel, the positive and negative components of voltage signals $V_{T1}$ and $V_{T2}$ must be 55 volts. In that case, the magnitude of the full select voltage swing would be equal to 220 volts while the magnitude of the half select voltage swing would be equal to 165 volts. Since the half select voltage swing is well below $V_{min}$, the balanced drive scheme of the present invention is capable of reliably firing selected cells of the display panel and of preventing the spurious firing of unselected cells. In addition, the peak value of the positive and negative components of voltage signals $V_{T1}$ and $V_{T2}$ is only 55 volts. Since the column and segment driver circuits only need to accommodate a maximum voltage of 55 volts, they can be easily realized by monolithic integrated circuits which are cheaper and easier to fabricate than the hybrid driver circuits presently in use.

Figure 2B:
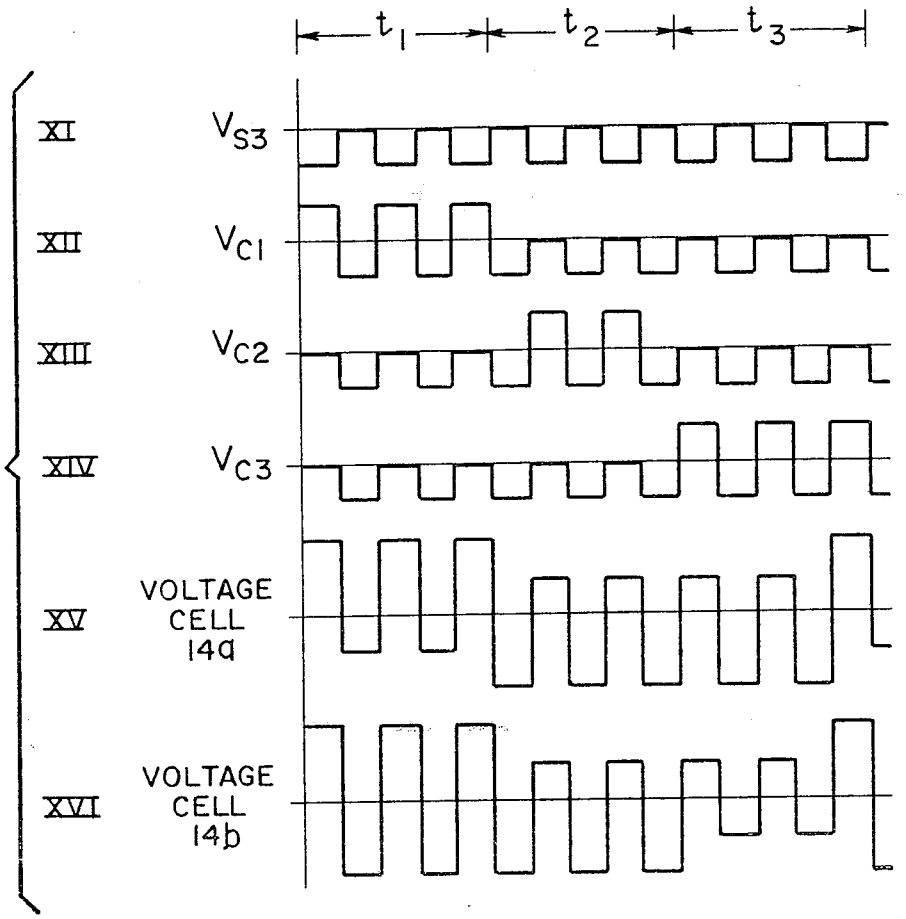
Figure 2C:
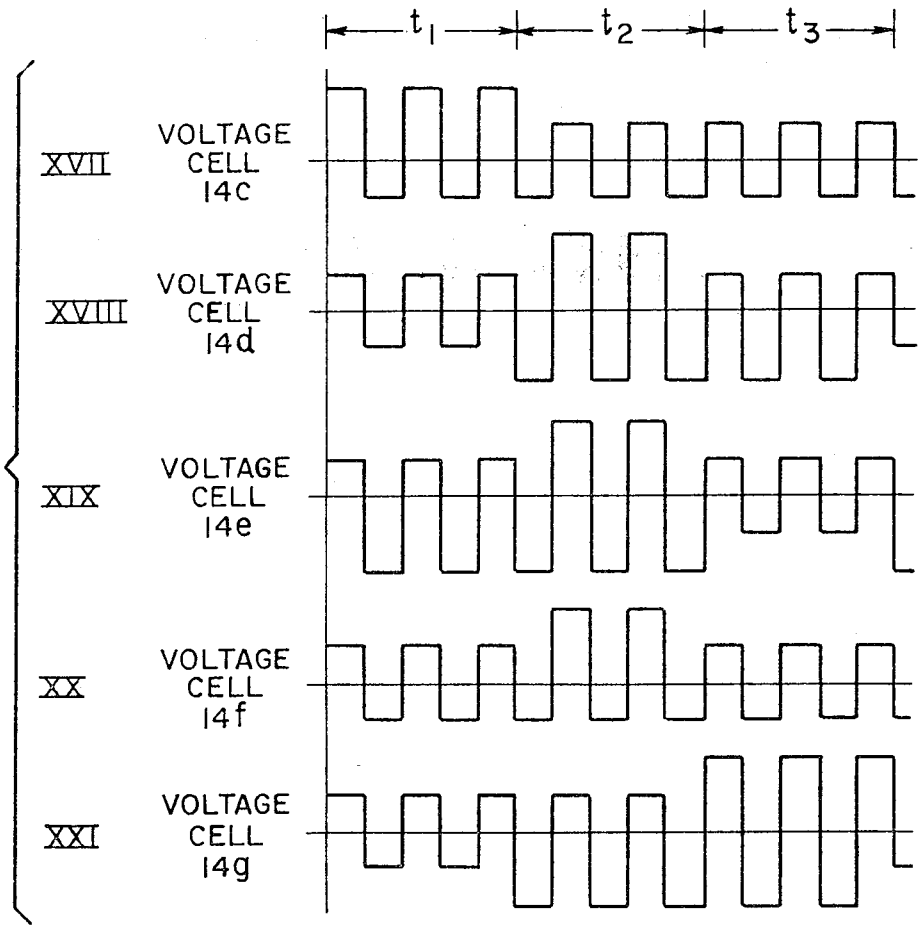
Figure 2D:
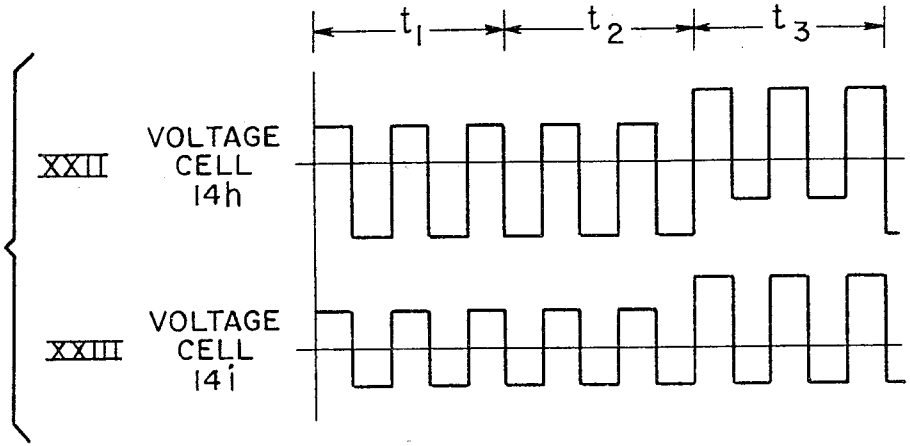

The voltage swing applied across each cell of the display matrix during implementation of the above-mentioned illumination pattern is graphically illustrated in lines XV–XXIII of FIGS. 2B, C and D. As shown in line XV of FIG. 2B, cell 14*a* is not discharged during the display operation because a voltage swing of sufficient magnitude is not applied to this cell. A half select voltage swing is applied across cell 14*a* during time periods $t_1$, $t_2$ and $t_3$. This type of voltage swing, however, is not sufficient to ionize the gas contained within cell 14*a*. As shown in line XVI of FIG. 2B, the voltage swing across cell 14*b* during time period $t_1$ is sufficient to illuminate this cell during this time period. A half select and unselected voltage swing, however, are applied across cell 14*b* during time periods $t_2$ and $t_3$, respectively. Accordingly, cell 14*b* is not illuminated during time periods $t_2$ or $t_3$. The voltage swing across cell 14*c*, during time periods $t_1$, $t_2$ and $t_3$, is insufficient to illuminate this cell. A waveform representing the voltage swing across cell 14*c* during these time periods is shown in line XVII of FIG. 2C. In this line of FIG. 2C, it can be seen that a half select voltage swing is present across cell 14*c* during time period $t_1$ and an unselected voltage swing is present across cell 14*c* during time periods $t_2$ and $t_3$. As shown in lines XVIII and XIX of FIG. 2C, cells 14*d* and 14*e* are illuminated during time period $t_2$ because the above-described driving operation produces a full select voltage swing across these cells during this period. A half select voltage swing is applied across cells 14*d* and 14*e* during time periods $t_3$ and $t_1$, respectively. An unselected voltage swing is present across cell 14*d* during time period $t_1$ while an unselected voltage swing is present across cell 14*e* during time period $t_3$. The waveform applied across cell 14*f* is shown in line XX of FIG. 2C. It can be seen from a review of this waveform that an unselected voltage swing is present across cell 14*f* during time periods $t_1$ and $t_2$ while a half select voltage swing is present across this cell during time period $t_3$. Accordingly, cell 14*f* is not illuminated during time periods $t_1$, $t_2$ or $t_3$. Cell 14*g* is shown in line XXI of FIG. 2C to have a sufficient voltage swing across it during time period $t_3$ to produce illumination of this cell during this time period. An unselected voltage swing, however, is present across cell 14*g* during time period $t_1$ and a half select voltage swing is present across this cell during time period $t_2$. As shown in lines XXII and XXIII of FIG. 2D, cells 14*h* and 14*i* are not illuminated by the present drive scheme. In particular, cell 14*h* has a half select voltage swing applied across it during time periods $t_1$, $t_2$ and $t_3$ while cell 14*i* has an unselected voltage swing applied across it during time periods $t_1$ and $t_2$ and a half select voltage swing applied across it during time period $t_3$.

From the foregoing, it can be seen that the drive scheme of the present invention effectively controls the operation of the display panel while significantly reducing the maximum voltage imparted to the panel through the segment and column driver circuits. In fact, the maximum voltage capability of the driver circuits is low enough to allow these circuits to be realized by DMOS and/or bipolar integrated circuits. Accordingly, the entire display control system can be quickly and easily manufactured using integrated circuit techniques.

Figure 3:
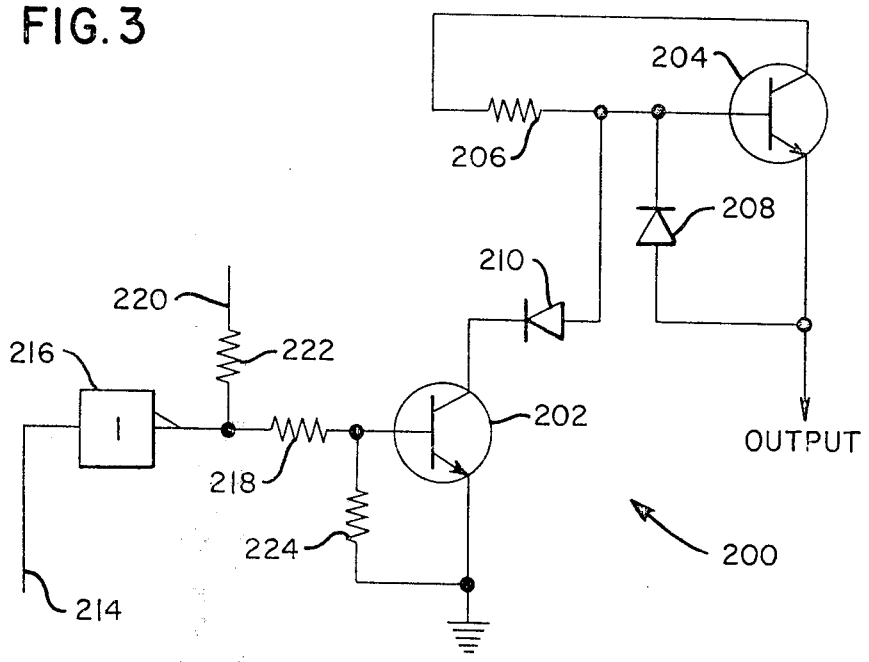
FIG. 3 is a schematic illustration of an alternate embodiment of a driver circuit suitable for use in the control circuit shown in FIG. 1.

Reference is now made to FIG. 3 wherein an alternate embodiment of a driver circuit suitable for use in the control system of FIG. 1 is designated by the numeral 200. The driver circuit shown in FIG. 3 can be used either as a column driver circuit or as a segment driver circuit.

The driver circuit shown in FIG. 3 is comprised of a pair of bipolar transistors 202 and 204. When the driver circuit 200 of FIG. 3 is incorporated into the control circuit of FIG. 1, the collector electrode of transistor 204 is coupled either with output 29 or output 31 of oscillator 16 depending upon whether the driver is being used as a column driver circuit or a segment driver circuit. The base electrode of transistor 204 is also coupled with its associated output of oscillator 16 through a resistor 206. The emitter electrode of transistor 204 is in turn electrically coupled with the circuit's associated segment or column electrode. The emitter electrode of transistor 204 is also coupled with its base electrode through a diode 208. The collector electrode of transistor 202 is in turn coupled with its associated output of oscillator 16 through a diode 210 and a resistor 206. The emitter electrode of transistor 202 is suitably coupled with system ground. Driver circuit 200 is also provided with an input 214 for receiving control signals from the circuit's associated multiplexing circuit 66 or serial input/parallel output buffer 42 depending upon whether the circuit is being used as a column driver circuit or as a segment driver circuit. Input 214 is in turn electrically coupled with the base electrode of transistor 202 through an inverter 216 and a resistor 218. A power input 220 is also coupled with the base electrode of transistor 202 in parallel with inverter 216 through a resistor 222. A resistor 224 is used to electrically couple the base electrode of transistor 202 with the emitter electrode of this transistor.

The driver circuit shown in FIG. 3 operates in the same manner as the column and segment driver circuits shown in FIG. 1. In particular, driver circuit 200 is capable of providing to its associated electrode a drive signal comprising the positive and negative components of the voltage signal applied to the driver circuit if the circuit is selected or of providing only the negative components of the voltage signal applied to the driver circuit if the circuit is not selected. Selection of the driver circuit 200 is controlled through the application of a control signal to input 214 of the circuit. In particular, the application of a low level logic signal to input 214 causes driver circuit 200 not to be selected.

While the application of a high level logic signal to input 214 causes the driver circuit to be selected, the application of a low level logic signal to input 214 causes a positive voltage signal to be applied to the base electrode of transistor 202. This positive voltage signal in turn causes transistor 202 to be maintained in a saturated condition thereby providing an electrical conduction path between the collector and emitter electrodes of this transistor. When the driver circuit is in this condition, the driver circuit is in an unselected condition wherein the positive components of the circuit's associated voltage signal ($V_{T1}$ or $V_{T2}$) are not passed to the circuit's associated electrode. In particular, receipt of a positive component of the circuit's associated voltage signal ($V_{T1}$ or $V_{T2}$) causes transistor 204 to be cut off, thereby dropping the positive component of the received voltage signal across the collector-emitter junction of this transistor. This action causes the circuit's electrode to be coupled to system ground through transistor 202 which is in a saturated condition when driver circuit 200 is not selected. During receipt of the negative components of the circuit's associated voltage signal, transistor 204 is maintained in a cutoff state but the circuit's associated electrode is connected to the circuit's associated output of oscillator 16 through diode 208 and the forward biased base-collector junction of transistor 204 which acts like a diode. Diode 210, however, serves to isolate the electrode from transistor 202. Accordingly, the negative components of the driver circuit's associated voltage signal are passed to the circuit's associated electrode regardless of the logic state of the control signal applied to input 214. This circuit implementation allows for the elimination of a diode due to the diode action of the base-collector junction of transistor 204.

To select the drive circuit shown in FIG. 3, a positive voltage signal is applied to input 214. Application of a high level logic signal to input 214 in turn causes a low level voltage signal to be applied to the base electrode of transistor 202, thereby causing this transistor to assume a cutoff condition. In this condition, the positive components of the circuit's associated voltage signal ($V_{T1}$ or $V_{T2}$) are no longer directed to system ground but rather are applied to the driver circuit's associated electrode. As mentioned above, the negative components of the driver circuit's associated voltage signal are applied to the circuit's associated electrode whether or not the circuit is selected. Accordingly, a drive signal comprising the positive and negative components of the circuit's associated voltage signal is passed to the driver circuit's associated electrode when the driver circuit is selected by the application of a high level control signal to input 214.

Figure 6:
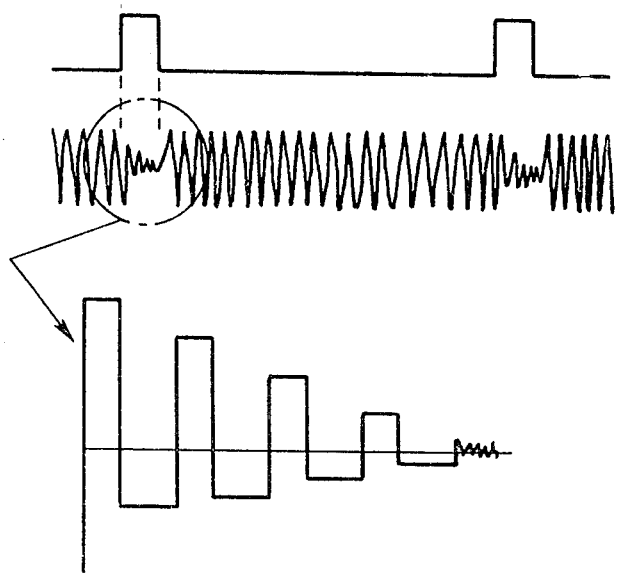
FIG. 6 is a waveform showing the blanking feature of the present invention.

An additional feature of the control system shown in FIGS. 1A–D is erasure of the wall charge stored in the various cells 14*a–i* of the display panel. This feature is known as blanking and serves to improve the operating range of the panel by reducing the chance of producing a spurious firing within an unselected cell due to wall charge stored in the cell during a previous discharge. This blanking feature is accomplished by simply removing the positive voltage signal from input 30 of oscillator 16. Removal of this voltage signal turns off oscillator 16 causing the voltage signals produced at outputs 29 and 31 of the oscillator to decay as shown in FIG. 6. As these voltage signals decay, the wall charge stored in the cells of the display panel is erased, thereby reducing the chance of initiating a spurious firing within an unselected cell.

Figure 4A:
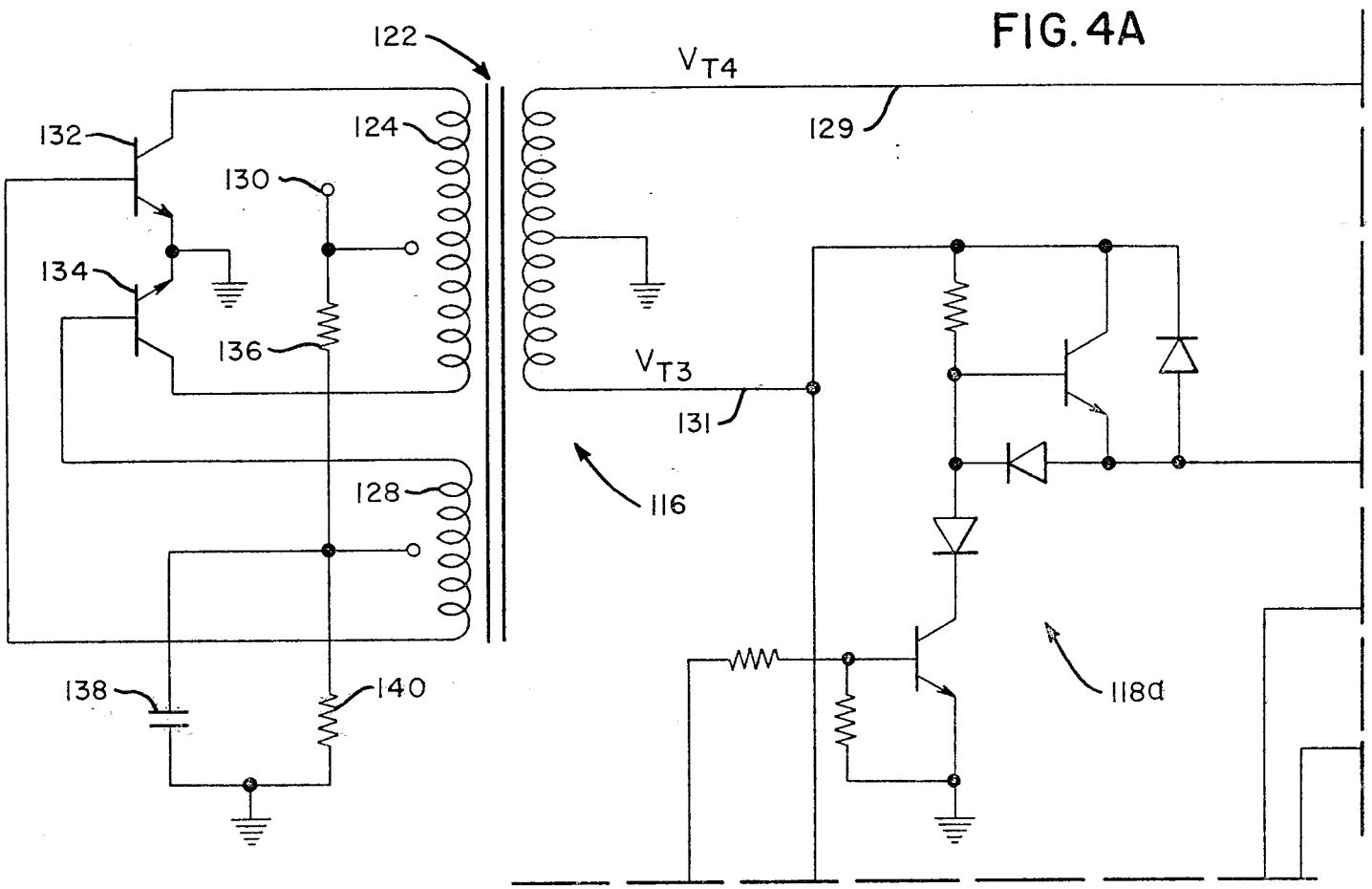
FIGS. 4A, B, C and D together comprise a detailed schematic diagram of a second control system for implementing the unbalanced drive scheme of the present invention.
Figure 4B:
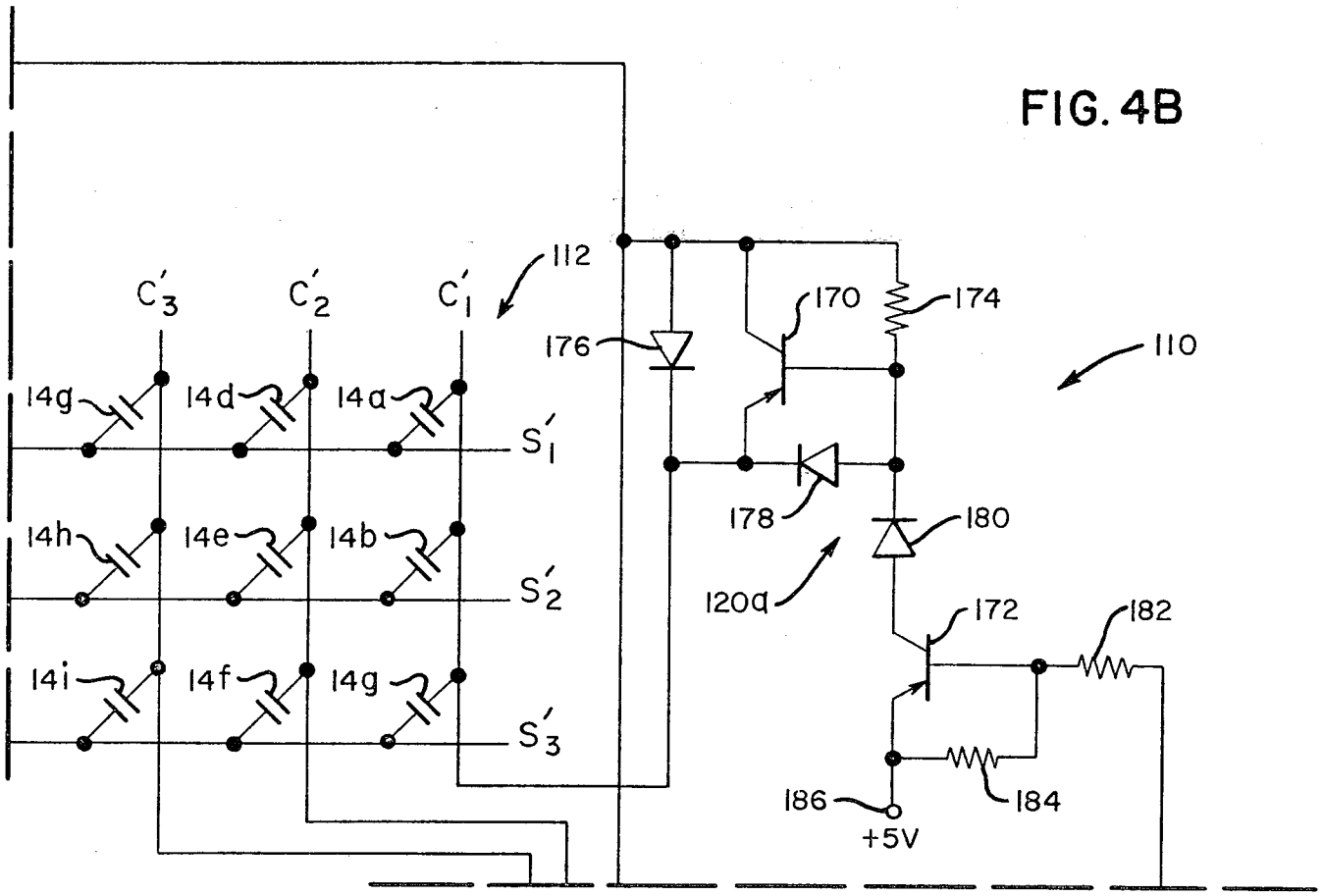

The operation of the display panel can be further improved by using a drive scheme with an unbalanced voltage swing. A control system for implementing such a drive scheme is shown in FIGS. 4A, B, C and D and is generally designated by the numeral 110. Control system 110 is used to drive a plasma display panel which is generally designated by the numeral 112 (FIG. 4B) and is comprised of a Royer oscillator which is generally designated by the numeral 116 (FIG. 4A), a plurality of segment driver circuits which are generally designated by the numerals 118*a*, 118*b* and 118*c* (FIGS. 4A and 4C) and a plurality of column driver circuits which are generally designated by the numerals 120*a*, 120*b* and 120*c* (FIGS. 4B and 4D).

Display panel 112 is identical in design, construction and operation to display panel 12 shown in FIG. 1. Like the display panel shown in FIG. 1, the display panel 112 is provided with a plurality of segment electrodes $S_1'$, $S_2'$ and $S_3'$ and a plurality of column electrodes $C_1'$, $C_2'$, and $C_3'$ which are arranged to form a plurality of cells which are designated by the numerals 114*a–i*.

Oscillator 116, like oscillator 16 of FIG. 1, is comprised of a transformer 122 having a primary coil 124, a secondary coil 126 with an upper output 129 and a lower output 131 and a tertiary coil 128. Oscillator 116 also includes a pair of switching transistors 132 and 134 which are interconnected with primary coil 124 and tertiary coil 128 as described above with respect to FIG. 1. To produce the desired voltage signals on the upper and lower outputs 129 and 131 of oscillator 116, secondary coil 126 is equipped with a center tap which is coupled with system ground. Primary coil 124, however, is arranged somewhat differently than primary coil 24 of oscillator 16 in FIG. 1. In particular, primary coil 124 is not provided with a center tap but rather is tapped at an offset location. This tap divides the primary coil into an upper and a lower section which are each comprised of an unequal number of turns. The turns ratio between the upper and lower sections of primary coil 124 and the turns ratio between primary coil 124 and secondary coil 126 are selected to produce at the upper and lower outputs 129 and 131 of oscillator 116 an AC voltage signal having an unbalanced voltage swing. To produce the desired voltage swing, the unidirectional firing voltage of display panel 112 is experimentally determined. This voltage level is then divided by two to arrive at the total voltage swing each voltage signal must obtain. A relationship between the larger and smaller components of the voltage signal is then selected. In selecting this relationship, it is desirable to make the larger component as large as possible without exceeding the operating voltage of the transistors used in the character and segment driver circuits. A convenient relationship, for example, would be somewhere on the order of 2:1. In order to achieve this ratio, primary coil 124 would have to be arranged to have twice as many turns in the upper half of the coil as in the lower half of the coil or vice versa.

A power input terminal 130 is in turn electrically coupled with the tap of primary coil 124, with the center tap of tertiary coil 128 through a resistor 136 and with system ground through resistor 136 and an RC network comprised of a capacitor 138 and a resistor 140.

Segment driver circuits 118*a*, 118*b* and 118*c* are identical in design, construction and operation to the segment driver circuits 18*a*, 18*b* and 18*c* which are shown in FIG. 1. Accordingly, a detailed description of segment driver circuits 118*a*, 118*b* and 118*c* will not be undertaken herein. It is sufficient to say that each of the segment driver circuits 118*a*, 118*b* and 118*c* is operatively coupled with a different output of serial input/parallel output buffer 142 and with a different segment electrode. Buffer 142 is identical in design and operation to buffer 42 of FIG. 1 and has its $D_0'$, $D_1'$ and $D_2'$ outputs operatively coupled with segment driver circuits 118*a*, 118*b* and 118*c*, respectively. Segment driver circuit 118*a* is in turn operatively coupled with segment electrode $S_1'$ while segment driver circuits 118*b* and 118*c* are operatively coupled with segment electrodes $S_2'$, and $S_3'$, respectively. In addition, all of the segment driver circuits 118*a*, 118*b* and 118*c* are operatively coupled with the lower output 131 of oscillator 116 to receive the AC voltage signal $V_{T3}$ produced at this output of the oscillator.

The control system is also equipped with three column driver circuits which are generally designated by the numerals 120*a*, 120*b* and 120*c*. Each of the column driver circuits 120*a*, 120*b* and 120*c* is operatively coupled with a different output of multiplexing circuit 166 and with a different column electrode. As shown in FIGS. 4A–D, column driver circuit 120*a* is operatively coupled with the $Y_0'$ output of multiplexing circuit 166 and with column electrode $C_1'$. Column driver circuit 120*b* is operatively coupled with the $Y_1'$ output of multiplexing circuit 166 and with column electrode $C_2'$ while column driver circuit 120*c* is operatively coupled with the $Y_3'$ output of multiplexing circuit 166 and with column electrode $C_3'$. All of the column driver circuits are also coupled with the upper output 129 of oscillator 116 to receive the voltage signal $V_{T4}$ produced at this output of the oscillator.

The column driver circuits 120*a*, 120*b* and 120*c* are somewhat different in design, construction and operation than the column driver circuits shown in FIG. 1. All of the column driver circuits 120*a*, 120*b*, and 120*c*, however, are identical in design, construction and operation. Since all of the column driver circuits shown in FIGS. 4A–D are identical in design and operation, only column driver circuit 120*a* will be described in detail herein.

Column driver circuit 120*a* is comprised of a pair of bipolar transistors 170 and 172. The collector of transistor 170 is directly coupled with the upper output 129 of oscillator 116 while the base of this transistor is coupled with the upper output 129 of oscillator 116 through a resistor 174. The base electrode of transistor 170 is also coupled with the anode of a diode 178 and with the cathode of a diode 180. The cathode of diode 178 is in turn electrically coupled with the emitter electrode of transistor 170 and with column electrode $C_1'$. The emitter electrode of transistor 170 is also connected with column electrode $C_1'$ and with the cathode of a third diode 176. The anode of diode 176 is in turn electrically coupled with output 129 of oscillator 116. Diode 180 has its anode electrically coupled with the collector electrode of transistor 172. The base electrode of transistor 172 is in turn electrically coupled with the $Y_0'$ output of multiplexing circuit 166 through a resistor 182. The base electrode of transistor 172 is also connected with the emitter electrode of this transistor via a resistor 184. The emitter electrode of transistor 172 also has a power input terminal 186 electrically coupled to it. In normal operation, input 186 has a bias voltage signal applied to it.

The multiplexing circuit 166 is similar in design and operation to multiplexing circuit 66 of FIG. 1. In particular, the multiplexing circuit is provided with a plurality of inputs $I_0'$, $I_1'$ and $I_2'$ for receiving a binary column address from an external source and a plurality of outputs $Y_0'$, $Y_1'$ and $Y_2'$ which are operatively coupled with the column driver circuits 120*a*, 120*b* and 120*c* as described above.

The serial input/parallel output buffer 142 is identical in design and operation to buffer 42 (FIG. 1*c*). As shown in FIGS. 4A–D, buffer 142 is provided with a serial data input 144 and a clock input 170 which is arranged to receive clock pulses from an external source (not shown herein). Buffer 142 is also equipped with a plurality of outputs $D_0'$, $D_1'$ and $D_2'$ which are each operatively coupled with a different one of the segment driver circuits 118*a*, 118*b* and 118*c* as described above.

Figure 5A:
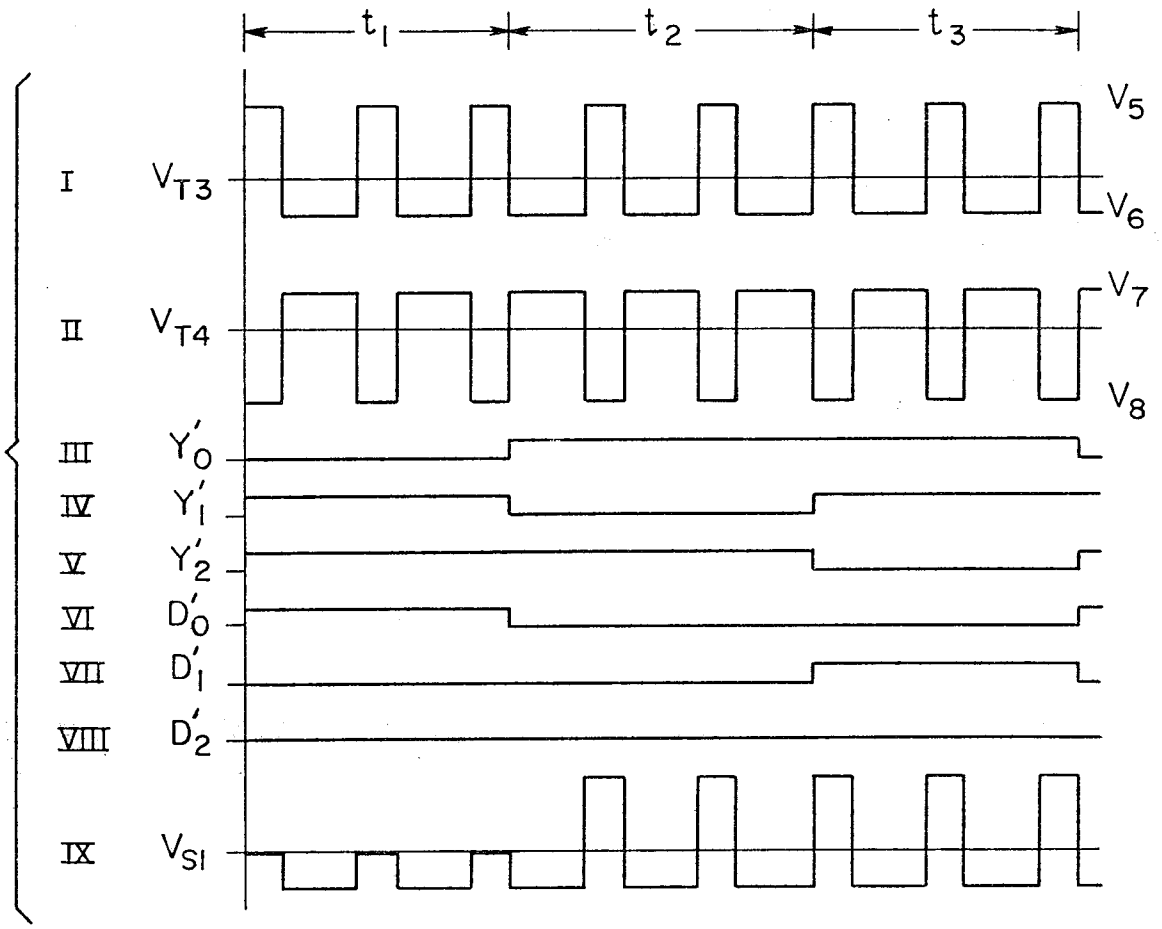
FIGS. 5A, B, C, D and E show a plurality of waveforms which illustrate the operation of the control circuit shown in FIG. 4.

In operation, a DC voltage signal is applied to power input 130 of oscillator 116 (FIG. 4A). The application of the DC voltage signal to power input 130 in turn causes oscillator 116 to produce a first AC voltage signal $V_{T3}$ at output 131 and a second AC voltage signal $V_{T4}$ at output 129. As with voltage signals $V_{T1}$ and $V_{T2}$ described with respect to FIGS. 1A–D, voltage signals $V_{T3}$ and $V_{T4}$ are produced at their respective outputs of the oscillator 180° out-of-phase so that a positive component of voltage signal $V_{T3}$ is present at output 131 while a negative component of voltage signal $V_{T4}$ is present at output 129 and vice versa. A schematic illustration of these two voltage signals is given in lines I and II of FIG. 5A. As shown in lines I and II of FIG. 5A, the voltage signal $V_{T3}$ is periodically varied between a predetermined positive voltage $V_5$ and a predetermined negative voltage $V_6$ while voltage signal $V_{T4}$ is periodically varied between a predetermined positive voltage $V_7$ and a predetermined negative voltage $V_8$. In this drive scheme of the invention, the magnitude of the positive and negative components of each of the voltage signals $V_{T3}$ and $V_{T4}$ is not the same. The positive and negative voltage limits of voltage signals $V_{T3}$ and $V_{T4}$ are selected by experimentally determining the firing voltage $V_{fire}$ of the panel. The firing voltage $V_{fire}$, as described above, is the lowest voltage which causes all the cells of the display panel to ignite when the cells are subjected to a sequence of alternating voltage pulses. Once the firing voltage is experimentally determined, this voltage is divided by two to arrive at the total voltage swing each voltage signal must obtain. A relationship between the positive and negative components of each voltage signal is then selected. In selecting this relationship, it is desirable to make one of the components as large as possible without exceeding the operating voltage of the transistors used in the column and segment driver circuits. A convenient relationship, for example, would be somewhere on the order of 2:1. In that case, positive voltage $V_5$ would be two times the absolute value of the negative voltage $V_6$. With respect to voltage signal $V_{T4}$, however, the relationship would be reversed, i.e., the absolute value of negative voltage $V_8$ would be two times the positive voltage $V_7$. The desired voltage swing is produced by selecting the appropriate turns ratio between the upper and lower sections of primary coil 124 and between primary coil 124 and secondary coil 126. In particular, a 2:1 ratio between the larger and smaller components of each of the voltage signals is established by arranging the primary coil 124 to have twice as many turns in the upper half of the coil as in the lower half of the coil or vice versa. The magnitude of the voltage swing is in turn established by providing a suitable turns ratio between primary coil 124 and secondary coil 126 using conventional techniques which are well-known to those of ordinary skill in the art.

The voltage signal $V_{T3}$ which is produced at output 131 of oscillator 116 is in turn provided to each of the segment driver circuits 118*a*, 118*b* and 118*c* while voltage signal $V_{T4}$ which is produced at output 129 of oscillator 116 is provided to each of the column driver circuits 120*a*, 120*b* and 120*c*. Each of the segment driver circuits 118*a*, 118*b* and 118*c* is selectively operable to pass to its respective segment electrode only the negative components of voltage signal $V_{T3}$ if it is not selected or to pass to its respective segment electrode both the positive and negative components of voltage signal $V_{T3}$ if it is selected. Each of the column driver circuits 120*a*, 120*b* and 120*c*, on the other hand, is operable to pass to its respective column electrode only the positive components of voltage signal $V_{T4}$ if it is not selected or to pass to its respective column electrode both the positive and negative components of voltage signal $V_{T4}$ if it is selected. Accordingly, a selected segment or column driver circuit is operable to pass to its associated electrode the positive and negative components of its corresponding voltage signal while an unselected column or segment driver circuit is operable to pass to its associated electrode only the smaller component of its corresponding voltage signal. As mentioned above, the application to a segment or column electrode of the positive and negative components of its associated voltage signal ($V_{T3}$ or $V_{T4}$) produces on the electrode a voltage signal which is herein referred to as a drive signal.

Figure 4C:
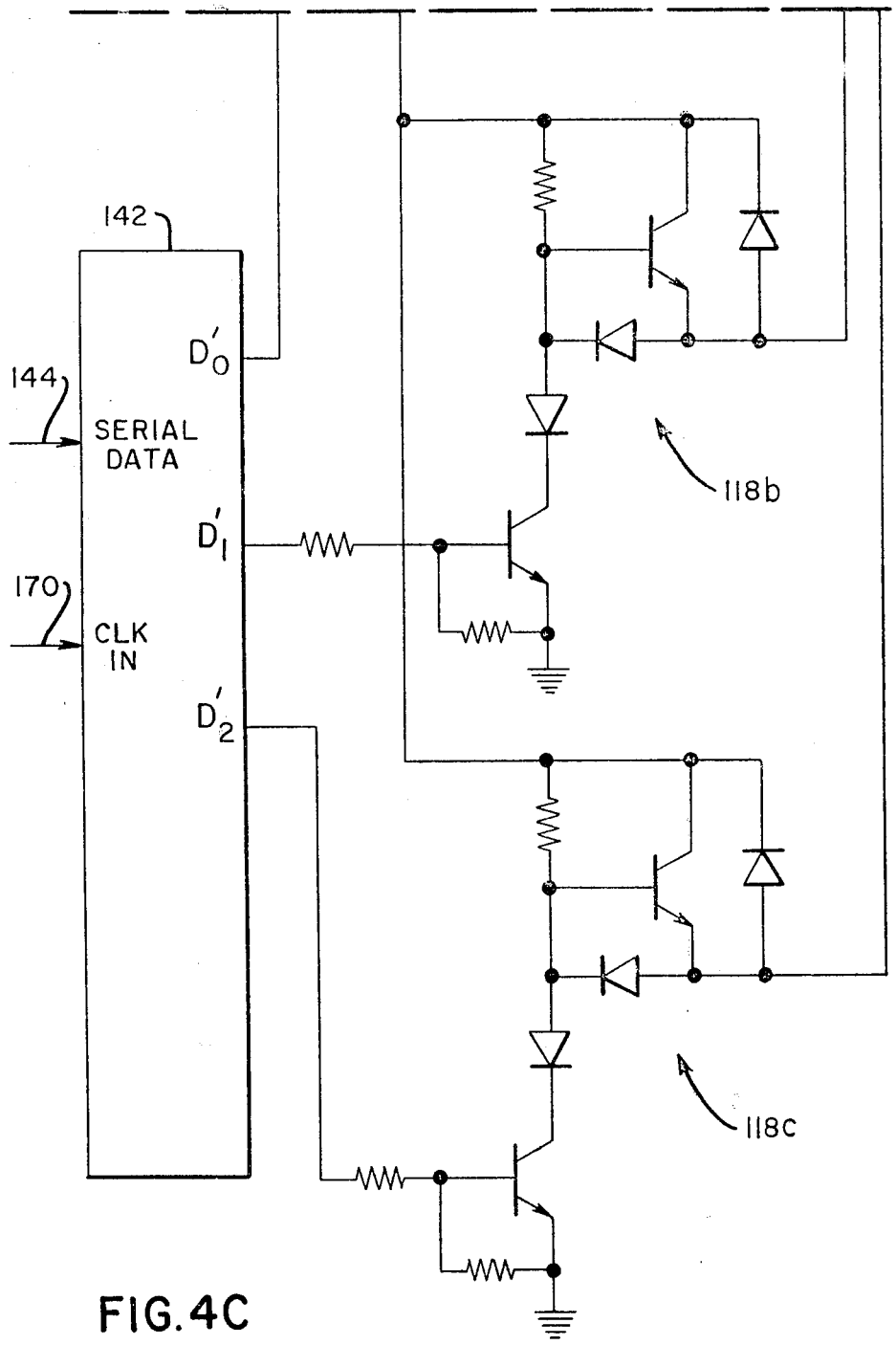
Figure 4D:
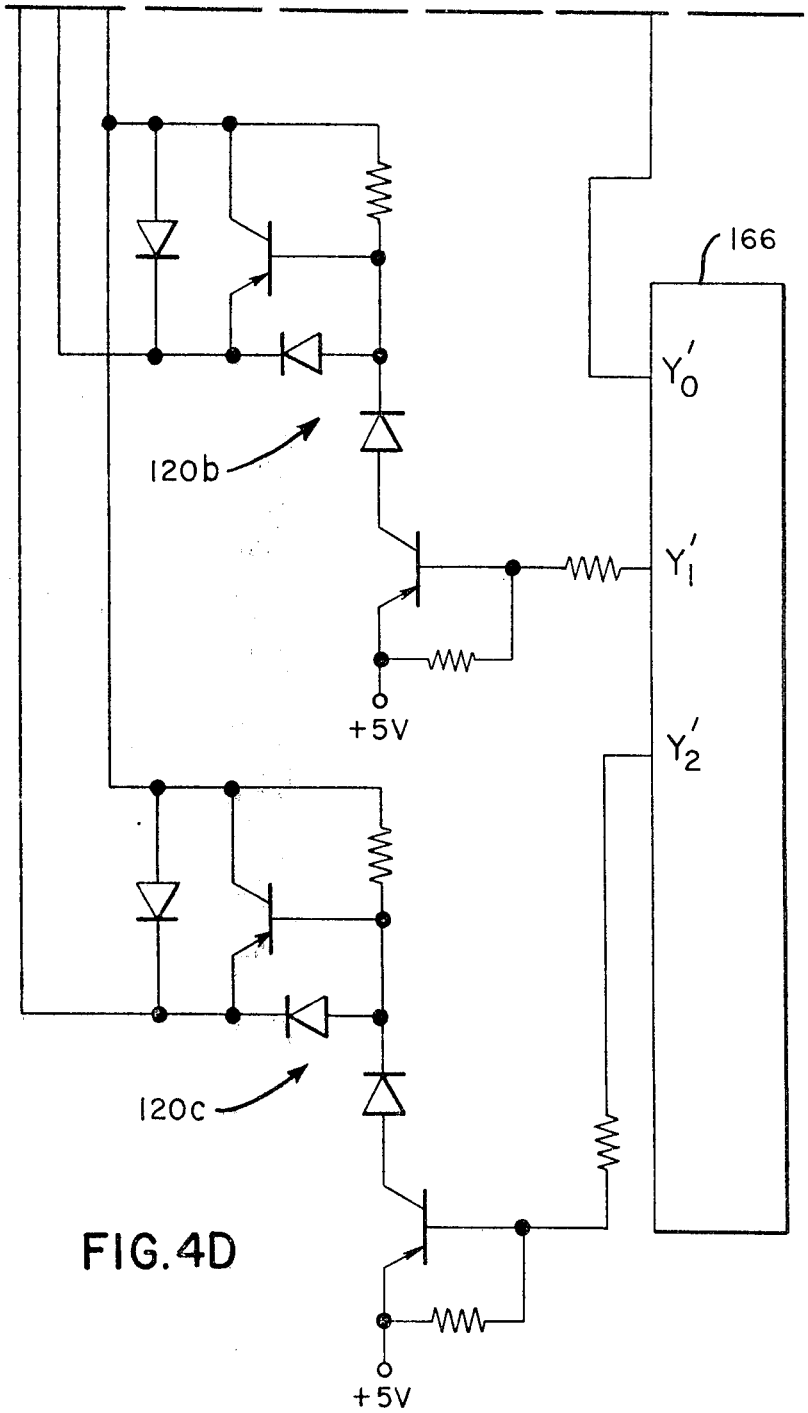

Selection of the column driver circuits is controlled by multiplexing circuit 166 (FIG. 4D) while selection of the segment driver circuits is controlled by the serial input/parallel output buffer 142 (FIG. 4C). As described above, multiplexing circuit 166 is arranged to receive address codes which are representative of one of the column electrodes $C_0'$–$C_2'$ from an external source (not shown herein) and to produce at its output a high level logic signal at the output corresponding to the column electrode designated by a received address code. In normal operation, each of the column electrodes is normally selected in a regularly repeating sequence. Accordingly, a series of address codes designating each of the column electrodes $C_0'$–$C_2'$ in a regularly repeating sequence is provided to the multiplexing circuit in normal operation. Such a series of address codes causes each of the outputs $Y_0'$–$Y_2'$ of the multiplexing circuit 166 to be pulsed to a high level logic state in a regularly repeating sequence which is graphically illustrated in lines III–V of FIG. 5A. As shown in lines III–V of FIG. 5A, the $Y_0'$ output of multiplexing circuit 166 is maintained at a high level logic state during time period $t_1$ while the $Y_1'$ and $Y_2'$ outputs are at a high level logic state during time periods $t_2$ and $t_3$, respectively. It should be noted that the application of an address code to multiplexing circuit 166 is accompanied by the application of a clock pulse to the clock input 170 of buffer 142 to synchronize the operation of buffer 142 and multiplexing circuit 166.

For a more detailed description of the operation of the column driver circuits shown in FIGS. 4A, B, C and D, reference is now made to column driver circuit 120*a* (FIG. 4B). When this circuit's associated output $Y_0'$ of multiplexing circuit 166 is at a low level logic state, the column driver circuit is not selected and, as a result, only the positive components of voltage signal $V_{T4}$ are passed to column electrode $C_1'$. In particular, the presence of a low level logic signal at output $Y_0'$ causes transistor 172 to be maintained in a saturated condition, thereby providing the bias voltage signal applied to power input terminal 186 to the base electrode of transistor 170. Application of this voltage signal to the base electrode of transistor 170 in turn causes the transistor 170 to remain in a cutoff condition regardless of the voltage of voltage signal $V_{T4}$. Accordingly, the negative components of voltage signal $V_{T4}$ are not capable of activating transistor 170 and, as a result, are not passed by column driver circuit 120*a* to column electrode $C_1'$. The positive voltage components of voltage signal $V_{T4}$, however, are passed to column electrode $C_1'$ through diode 176 regardless of the logic condition of the circuit's associated output $Y_0'$ of multiplexing circuit 166.

As mentioned above, selection of column driver circuit 120*a* is accomplished by providing a high level logic signal at output $Y_0'$ of multiplexing circuit 166. The presence of a high level logic signal at output $Y_0'$ of multiplexing circuit 166 causes transistor 172 of column driver circuit 120*a* to be maintained in a cutoff condition. In this condition, the bias voltage signal applied to power input terminal 186 is not provided to the base electrode of transistor 170. In the absence of this voltage signal, transistor 170 becomes conductive each time a negative component of voltage signal $V_{T4}$ is received. Upon becoming conductive, transistor 170 provides a conduction path for the received negative component of voltage signal $V_{T4}$. Accordingly, the received negative component of voltage signal $V_{T4}$ is passed by column driver circuit 120*a* to its associated column electrode $C_1'$ when the driver circuit is selected in response to a high level logic signal at output $Y_0'$ of multiplexing circuit 166. The positive components of voltage signal $V_{T4}$ are still applied to column electrode $C_1'$ through diode 176 as described above. In this way, the column driver circuit 120*a* is operable to provide to column electrode $C_1'$ a drive signal comprising the positive and negative components of voltage signal $V_{T4}$ when it is selected and to provide only the positive components of voltage signal $V_{T4}$ to column electrode $C_1'$ when it is not selected.

Figure 5B:
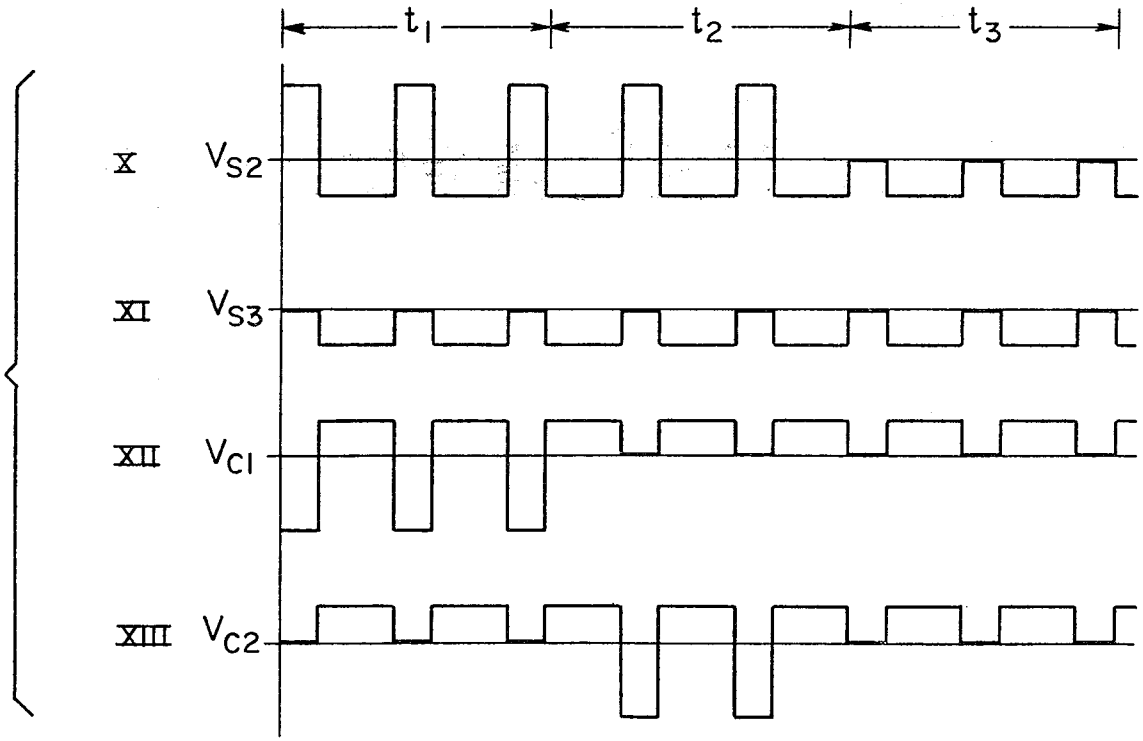

All of the column driver circuits operate in the same manner. Accordingly, each of the column driver circuits 120*a*, 120*b* and 120*c* is capable of providing to its associated column electrode only the negative components of voltage signal $V_{T4}$ when the driver is not selected and a drive signal comprising the positive and negative components of voltage signal $V_{T4}$ when the driver circuit is selected. As mentioned above, column driver circuit 120*a* is selected during time period $t_1$ while column driver circuits 120*b* and 120*c* are selected during time periods $t_2$ and $t_3$, respectively. As a result, the positive and negative components of voltage signal $V_{T4}$ are applied to column electrode $C_1'$ during time period $t_1$, while the positive and negative components of voltage signal $V_{T4}$ are applied to column electrodes $C_2'$ and $C_3'$ during time periods $t_2$ and $t_3$, respectively. Only the positive components of voltage signal $V_{T4}$ are applied to these electrodes during the other time periods. This operation is graphically illustrated in lines XII–XIV of FIGS. 5B and C.

Buffer 142 is operable to control selection of the segment driver circuits 118*a*, 118*b* and 118*c* (FIGS. 4A and 4C). Buffer 142 is responsive to serial data provided to the buffer via serial data input 144 and clock pulses provided to the buffer via clock input 170 to produce at its outputs $D_0'$, $D_1'$ and $D_2'$ the combination of select signals needed to illuminate the designated combination of cells which are attached to the column electrode associated with the presently-selected column driver circuit.

The operation of the segment driver circuits 118*a*, 118*b* and 118*c* is identical to the operation of the segment driver circuits 18*a*, 18*b* and 18*c* shown in FIGS. 1A–D and, as a result, another description of the operation of the segment driver circuits will not be undertaken herein. It is sufficient to note that each of the segment driver circuits 118*a*, 118*b* and 118*c* is operable to provide a drive signal comprising the positive and negative components of voltage signal $V_{T3}$ to its associated segment electrode whenever a low level logic signal is present on its associated output of buffer 142 and to provide only the negative components of voltage signal $V_{T3}$ to its associated segment electrode whenever a high level logic signal is present on its associated output of buffer 142.

As with the description of the control system 10 shown in FIGS. 1A–D, it is assumed for the purposes of discussion herein that the received serial data indicates that cells 114*b*, 114*d*, 114*e* and 114*g* are to be illuminated. Illumination of cell 114*b* is accomplished by providing a drive signal comprising the positive and negative components of voltage signal $V_{T3}$ *to segment electrode* $S_1'$ at the same time as a drive signal comprising the positive and negative components of voltage signal $V_{T4}$ is provided to column electrode $C_1'$. Cells 114*d* and 114*e* are in turn illuminated by applying a drive signal comprising the positive and negative components of voltage signal $V_{T3}$ to segment electrodes $S_1'$ and $S_2'$ coincident with the application of a drive signal comprising the positive and negative components of voltage signal $V_{T4}$ to column electrode $C_2'$. Illumination of cell 114*g* is similarly accomplished by providing a drive signal comprising the positive and negative components of voltage signal $V_{T3}$ to segment electrode $S_1'$ while a drive signal comprising the positive and negative components of voltage signal $V_{T4}$ is applied to column electrode $C_3'$. In order to effectuate the desired illumination pattern, segment driver circuit 118*b* must be selected by buffer 142 coincident with the selection of column driver circuit 120*a* by multiplexing circuit 166, segment driver circuits 118*a* and 118*b* must be selected coincident with the selection of column driver circuit 120*b*, and segment driver circuit 118*a* must be selected coincident with selection of column driver circuit 120*c*. As described above with respect to lines XII–XIV of FIGS. 5B and C, column driver circuits 120*a*, 120*b* and 120*c* are selected during time periods $t_1$, $t_2$ and $t_3$, respectively. Accordingly the above-described illumination pattern is effectuated by placing the $D_0'$ output of buffer 142 at a low level logic state during time periods $t_2$ and $t_3$ and the $D_1'$ output of buffer 142 at a low level logic state during time periods $t_1$ and $t_2$. The waveforms present on the segment electrodes $S_1'$, $S_2'$ and $S_3'$ as a result of this selection pattern are shown in lines IX–XI of FIGS. 5A and B. In particular, a drive signal comprising the positive and negative components of voltage signal $V_{T3}$ is provided to segment electrode $S_1'$ during time periods $t_2$ and $t_3$ while only the negative components of this voltage signal are applied to segment electrode $S_1'$ during time period $t_1$. Additionally, a drive signal comprising the positive and negative components of voltage signal $V_{T3}$ is applied to segment electrode $S_2'$ during time periods $t_1$ and $t_2$ while only the negative components of this voltage signal are applied to segment electrode $S_2'$ during time period $t_3$ as shown in line X of FIG. 5B. As shown in line XI of FIG. 5B, only the negative components of voltage signal $V_{T3}$ are applied to segment electrode $S_3'$ during time periods $t_1$, $t_2$ and $t_3$ since segment driver circuit 118*c* is not selected during any of these time periods. Accordingly, the positive and negative components of voltage signals $V_{T3}$ and $V_{T4}$ are simultaneously applied to cell 114*b* during time period $t_1$, to cells 114*d* and 114*e* during time period $t_2$ and to cell 114g during time period $t_3$, thereby causing these cells to be illuminated during these time periods.

Figure 5C:
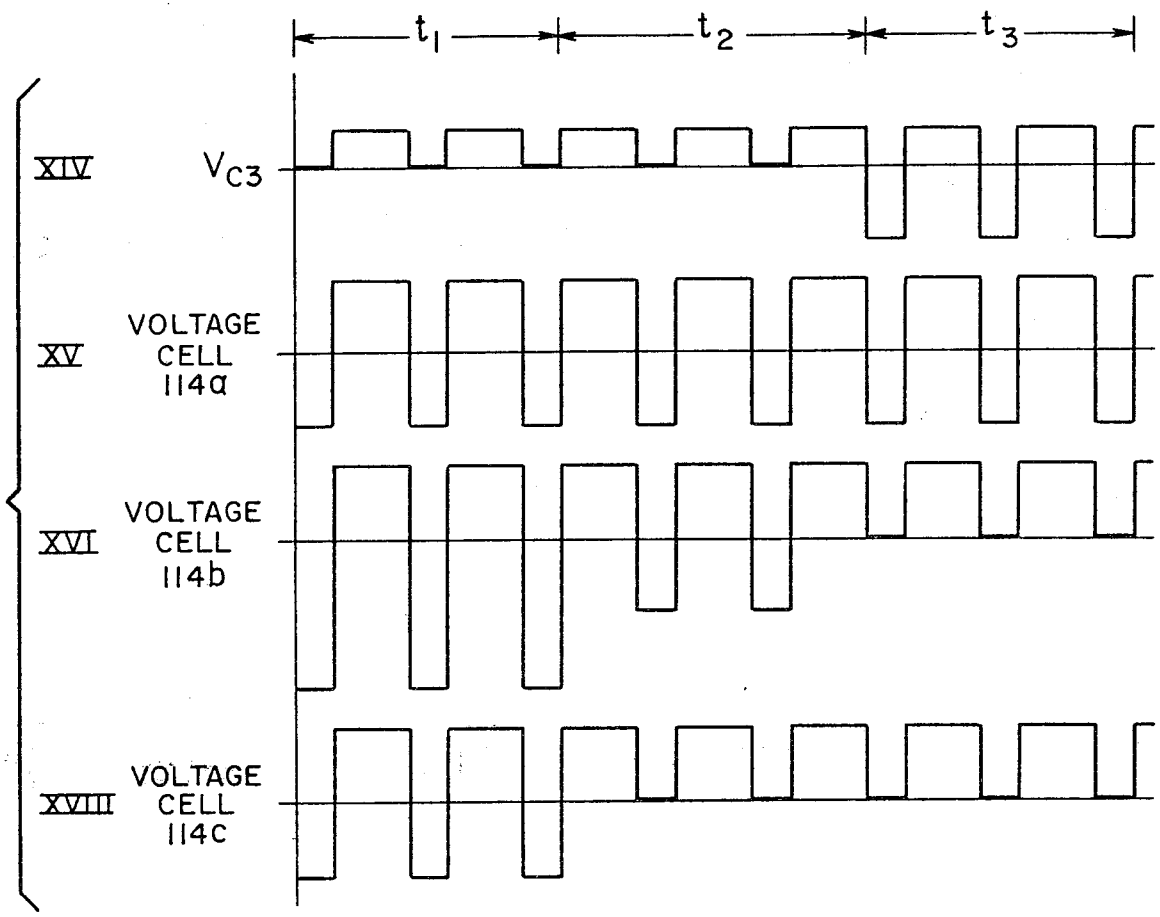
Figure 5D:
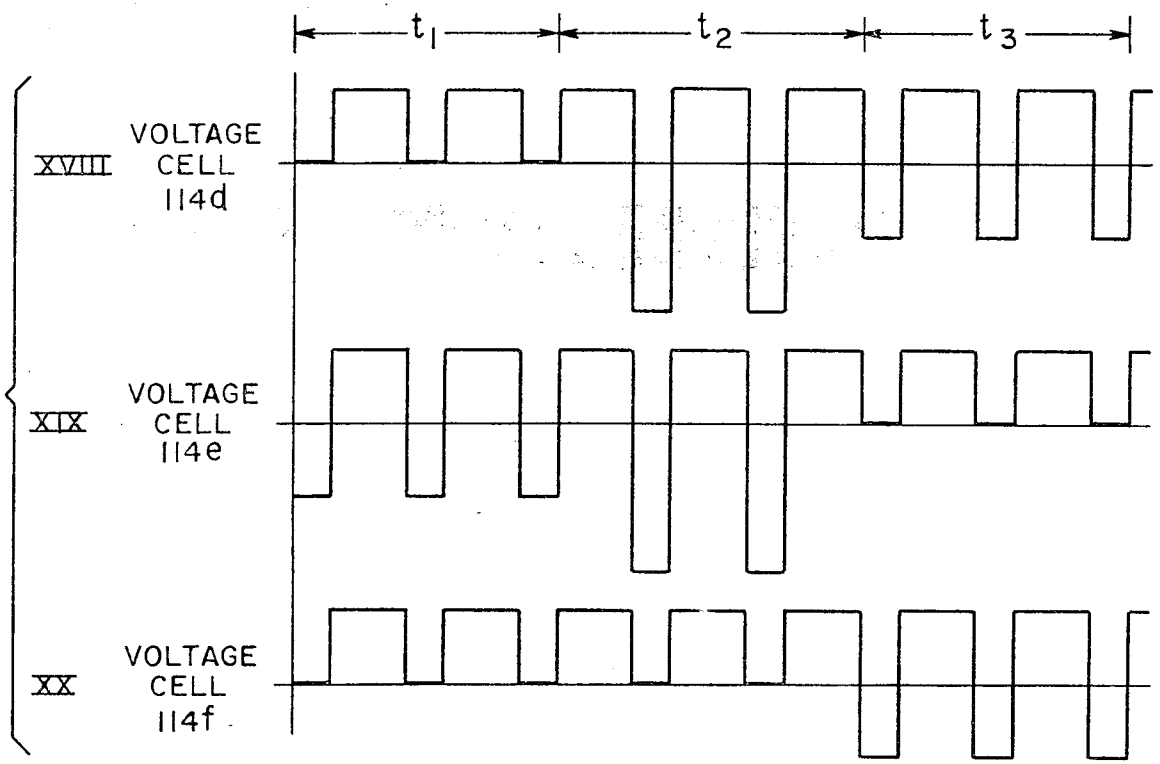
Figure 5E:
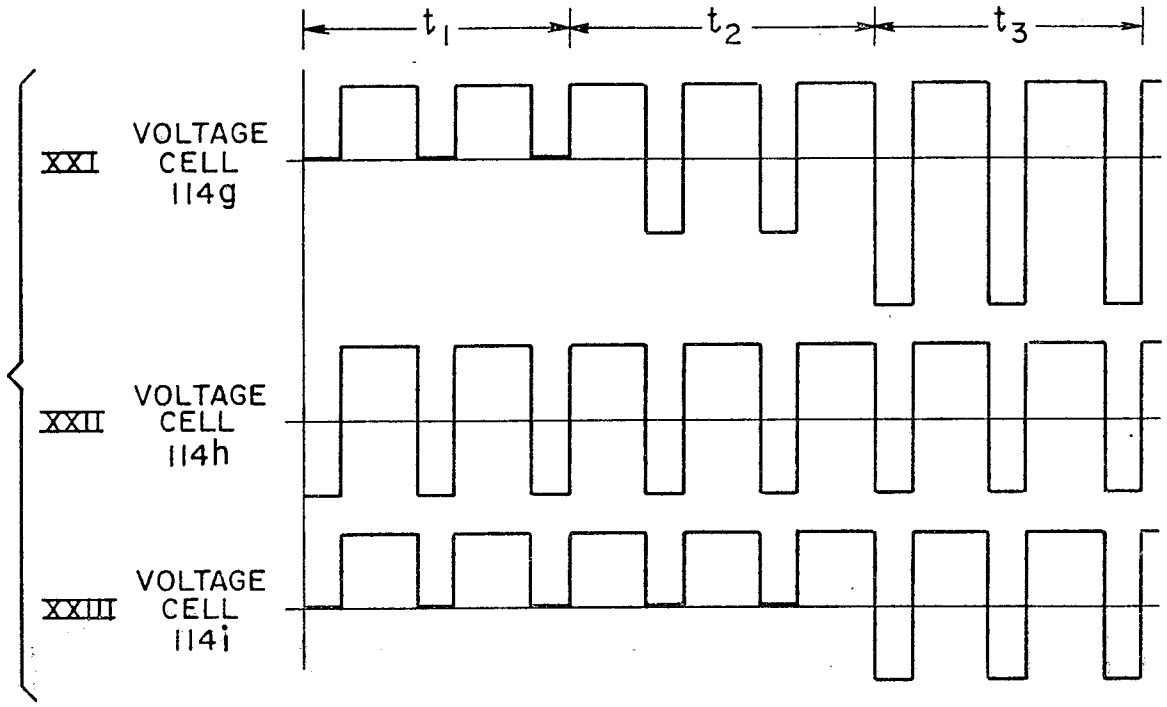

The voltage applied across each cell of the display matrix 112 is graphically illustrated in lines XV–XXIII of FIGS. 5C, D and E. The voltage swing across cell 114a is shown in line XV of FIG. 5C. As shown therein, a half select voltage swing is applied across cell 114a during time periods $t_1$, $t_2$, and $t_3$ and, as a result, this cell is not illuminated during any of these time periods. Line XVI of FIG. 5C shows the voltage swing across cell 114b during time periods $t_1$, $t_2$ and $t_3$. A full select voltage swing is applied across this cell during time period $t_1$ causing this cell to be illuminated during this time period. Cell 114b has a half select voltage swing and an unselected voltage swing applied across it during time periods $t_2$ and $t_3$, respectively. Line XVII of FIG. 5C shows the voltage swing across cell 114c during time periods $t_1$, $t_2$ and $t_3$. A half select voltage swing is applied across cell 114c during time period $t_1$ and an unselected voltage swing is applied across cell 114c during time periods $t_2$ and $t_3$. As shown in lines XVIII and XVIX of FIG. 5B, cells 114b and 114c have a full select voltage swing applied across them during time period $t_2$ and, as a result, are illuminated during this time period. During time period $t_1$, however, cell 114d has an unselected voltage swing applied across it while cell 114e has a half select voltage swing applied across it. A half select voltage swing is present across cell 114b while an unselected voltage swing is present across cell 114e during time period $t_3$. Accordingly, cells 114b and 114e are not illuminated during time periods $t_1$ and $t_3$. The voltage applied across cell 114f during time periods $t_1$, $t_2$ and $t_3$ is shown in line XX of FIG. 5D. Cell 114f is not illuminated during any of these time periods because it has an unselected voltage swing present across it during time periods $t_1$ and $t_2$ and a half select voltage swing present across it during time period $t_3$. As shown in line XXI of FIG. 5E, a full select voltage swing is produced across cell 114g during time period $t_3$. Cell 114g has an unselected and half select voltage swing respectively applied across it during time periods $t_1$ and $t_2$ and, as a result, is not illuminated during these time periods. Line XXII of FIG. 5E shows that a half select voltage swing is applied across cell 114h during time periods $t_1$, $t_2$ and $t_3$. The voltage swing applied across the cell 114i of panel 112 is graphically illustrated in line XXIII of FIG. 5E. This line of FIG. 5E shows that cell 114i has an unselected voltage swing applied across it during time periods $t_1$ and $t_2$ and a half select voltage swing applied across it during time period $t_3$.

The simultaneous application of a drive signal to the segment and column electrodes associated with a designated cell produces a voltage swing $V_F$, across the cell which is equal to the sum of the voltage swings of the voltage signals $V_{T3}$ and $V_{T4}$. In other words, the actual pulse height applied across the designated cell is equal to the sum of the positive voltages $V_5$ and $V_7$ which respectively mark the upper boundaries of voltage signals $V_{T3}$ and $V_{T4}$ plus the sum of the absolute values of the negative voltages $V_6$ and $V_8$ which respectively mark the lower boundaries of voltage signals $V_{T3}$ and $V_{T4}$. The magnitude of the voltage swing is defined by the following equation:

$$V_F = V_5 + |V_6| + V_7 + |V_8| > V_{fire}$$

where $V_{fire}$ is the lowest voltage which causes all of the cells of the display panel to ignite when they are subjected to a sequence of alternating voltage pulses.

In this embodiment of the invention, a half select voltage is present across an undesignated cell when a drive signal is applied to only one of the cell's associated electrodes. If the drive signal is applied to the cell's column electrode, the magnitude of the voltage swing across the cell is given by the following equation:

$$V_{half\ select} = V_7 + |V_8| + V_6| < V_{min}.$$

As shown by this equation, the magnitude of the voltage swing across the cell is equal to the sum of the absolute value of the peak negative voltage $V_8$ of voltage signal $V_{T4}$, the peak positive voltage $V_7$ of voltage signal $V_{T4}$ and the absolute value of the peak negative voltage $V_6$ of voltage signal $V_{T3}$. If the drive signal is applied to the cell's segment electrode, the voltage swing across the cell is given by the following equation:

$$V_{half\ select} = V_5 + |V_6| + V_7 < V_{min}.$$

In this case, the magnitude of the voltage swing across the cell is equal to the sum of the peak positive voltage of voltage signal $V_{T3}$, the absolute value of the peak negative voltage $V_6$ of voltage signal $V_{T3}$ and the peak positive voltage $V_7$ of voltage signal $V_{T4}$.

It should be noted at this time that the half select voltage is greatly reduced by using an unbalanced drive scheme such as that shown in FIGS. 5A–E and implemented by the control system shown in FIGS. 4A–D. Through the use of an unbalanced drive scheme, one of the components of each of the voltage signals $V_{T3}$ and $V_{T4}$ is significantly larger than the other component of the voltage signal. In this embodiment of the invention, only the smaller components of the voltage signals are applied to an unselected column or segment electrode. By reducing the magnitude of the components which are applied to an unselected column or segment electrode, the components which contribute to the half select voltage swing are correspondingly reduced in magnitude, thereby producing a similar reduction in the half select voltage applied to an unselected cell. If the firing voltage $V_{fire}$ of the panel 112 is equal to 220 volts for example, the voltage swing across a designated cell must be equal to 220 volts. In this case, a balanced drive scheme (such as that shown in FIGS. 2A–D) would require each component of the voltage signals $V_{T1}$ and $V_{T2}$ to be equal to 55 volts. As a result, the half select voltage across an unselected cell would be equal to the sum of three of these components or 165 volts. By using an unbalanced drive scheme such as that shown in FIGS. 5A–E, one of the components which comprises the half select voltage can be significantly decreased. By using a 2:1 voltage swing wherein the larger component of each voltage signal has an absolute value equal to approximately 75 volts and the smaller component of each voltage signal has an absolute value of approximately 35 volts, the magnitude of one of the components which contributes to the half select voltage swing is significantly reduced, thereby producing a corresponding decrease in the magnitude of the half select voltage. In this case, the half select voltage swing across an unselected cell is only 140 volts ($V_{half\ select} = 75 + 35 + 35$) instead of the 165 volts produced by the balanced drive scheme. The voltage swing across an unselected cell is also reduced by using the unbalanced drive scheme because the magnitude of the components applied to the unselected cell is significantly reduced. For example, the voltage swing across an unselected cell is 70 volts if an unbalanced drive scheme is used and 110 volts if a balanced drive scheme is used. Accordingly, the use of an unbalanced drive scheme significantly improves the operating range of the display panel by reducing the chance of producing a spurious firing of an unselected cell.

The blanking feature shown in FIG. 6 and described with respect to this Figure is also applicable to the control circuit shown in FIGS. 4A–D. In particular, removal of the positive voltage signal from input 130 of oscillator 116 causes the voltage signals $V_{T3}$ and $V_{T4}$ produced at outputs 129 and 131 of the oscillator to decay as shown in FIG. 6. As these voltage signals decay, the wall charge stored on the walls of display panel 112 is erased, thereby reducing the chance of initiating a spurious firing with an unselected cell.

From the foregoing, it can be seen that this invention is one well-adapted to attain all the ends and objects hereinabove set forth, together with other advantages which are obvious and which are inherent to the structure.

While the invention has been particularly shown and described with reference to preferred embodiments thereof, it will be understood by those skilled in the art that various changes in form and detail may be made therein without departing from the spirit and scope of the invention.

We claim:

1. A control system for driving a plasma display panel having a plurality of first electrodes extending in a first direction and a plurality of second electrodes extending in a second direction wherein said first electrodes are maintained in a spaced-apart relationship from said second electrodes to form a gas discharge cell at each point where one of said first electrodes crosses over one of said second electrodes, said control system comprising:

oscillator means for producing a first voltage signal, having an alternating sequence of positive and negative components respectively reaching a first predetermined positive voltage and a first predetermined negative voltage, and a second voltage signal, having an alternating sequence of positive and negative components respectively reaching a second predetermined positive voltage and a second predetermined negative voltage, wherein the positive components of said first voltage signal substantially coincide with the negative components of said second voltage signal and the negative components of said first voltage signal substantially coincide with the positive components of said second voltage signal;

first driver means for selectively applying the positive and negative components of said first voltage signal to said first electrodes; and second driver means for selectively applying the positive and negative components of said second voltage signal to said second electrodes.

2. A control system as set forth in claim 1 wherein said oscillator means is comprised of a transformer having a primary winding with a pair of end taps and an interior tap and a pair of secondary windings;

a power input for providing a reference voltage to the interior tap of said primary winding;

switching means for alternately coupling each end tap of said primary winding to ground; and said primary and secondary windings being arranged to produce a first voltage signal at one of said secondary windings and a second voltage signal at the other of said secondary windings, such that the first predetermined positive voltage is equal to the absolute value of the first predetermined negative voltage and such that the second predetermined positive voltage is equal to the absolute value of the second predetermined negative voltage.

3. A control system as set forth in claim 2 wherein said first driver means is comprised of a first driver circuit associated with each of said first electrodes wherein each first driver circuit includes means for applying the positive and negative components of said first voltage signal to the first electrode associated with the first driver circuit and means for inhibiting the application of one of the components of said first voltage signal to the first electrode associated with the first driver circuit if a select signal is not being received by the first driver circuit from an external source.

4. A control system as set forth in claim 3 wherein said inhibiting means is comprised of switch means for directing one of the components of said first voltage signal to ground rather than to the first electrode associated with the first driver circuit if a select signal is not being received by the first driver circuit from an external source.

5. A control system as set forth in claim 4 wherein said means for applying the positive and negative components of said first voltage signal to the first electrode associated with the first driver circuit is comprised of a parallel combination of a diode with its cathode electrically coupled with said one of said secondary windings and its anode electrically coupled with the first electrode associated with the first driver circuit and a first NPN transistor with its collector and base electrodes electrically coupled with said one of said secondary windings and its emitter electrode electrically coupled with the first electrode associated with the first driver circuit.

6. A control system as set forth in claim 5 wherein said switch means is comprised of a second NPN transistor having its collector electrode electrically coupled with the emitter electrode of said first NPN transistor and with the anode of said diode, its base electrode arranged to receive a select signal from an external source, and its emitter electrode electrically coupled with system ground.

7. A control system as set forth in claim 2 wherein said second driver means is comprised of a second driver circuit associated with each of said second electrodes wherein each second driver circuit includes means for applying the positive and negative components of said second voltage signal to the second electrode associated with the second driver circuit and means for inhibiting the application of one of the components of said second voltage signal to the second electrode associated with the second driver circuit if a select signal is not being received by the second driver circuit from an external source.

8. A control system as set forth in claim 7 wherein said inhibiting means is comprised of switch means for directing one of the components of said second voltage signal to system ground rather than to the second electrode associated with the second driver circuit if a select signal is not being received by the second driver circuit from an external source.

9. A control system as set forth in claim 8 wherein said means for applying the positive and negative components of said second voltage signal to the second electrode associated with the second driver circuit is comprised of a parallel combination of a diode with its cathode electrically coupled with said other of said secondary windings and its anode electrically coupled with the second electrode associated with the second driver circuit and a first NPN transistor with its collector and base electrodes electrically coupled with said other of said secondary windings and its emitter electrode electrically coupled with the second electrode associated with the second driver circuit.

10. A control system as set forth in claim 9 wherein said switch means is comprised of a second NPN transistor having its collector electrode electrically coupled with the emitter electrode of said first NPN transistor and with the anode of said diode, its base electrode arranged to receive a select signal from an external source, and its emitter electrode electrically coupled with ground.

11. A control system as set forth in claim 1 wherein said oscillator means is comprised of a transformer having a primary winding with a pair of end taps and an interior tap and a pair of secondary windings;

a power input for providing a reference voltage to the interior tap of said primary winding;

switching means for alternately coupling each end tap of said primary winding to ground; and said primary and secondary windings being arranged to produce a first voltage signal at one of said secondary windings and a second voltage signal at the other of said secondary windings such that the first predetermined positive voltage is greater than the absolute value of the first predetermined negative voltage and such that the second predetermined positive voltage is less than the absolute value of the second predetermined negative voltage.

12. A control system as set forth in claim 11 wherein said first driver means is comprised of a first driver circuit associated with each of said first electrodes wherein each first driver circuit includes means for applying the positive and negative components of said first voltage signal to the first electrode associated with the first driver circuit and means for inhibiting the application of the positive components of said first voltage signal to the first electrode associated with the first driver circuit if a select signal is not being received by the first driver circuit from an external source.

13. A control system as set forth in claim 12 wherein said inhibiting means is comprised of switch means for directing the positive components of said first voltage signal to system ground rather than to the first electrode associated with the first driver circuit if a select signal is not being received by the first driver circuit from an external source.

14. A control system as set forth in claim 13 wherein said means for applying the positive and negative components of said first voltage signal to the segment electrode associated with the first driver circuit is comprised of a parallel combination of a diode with its cathode electrically coupled with said one of said secondary windings and its anode electrically coupled with the first electrode associated with the first driver circuit and a first NPN transistor with its collector and base electrodes electrically coupled with said one of said secondary windings and its emitter electrode electrically coupled with the first electrode associated with the first driver circuit.

15. A control system as set forth in claim 14 wherein said switch means is comprised of a second NPN transistor having its collector electrode electrically coupled with the emitter electrode of said first NPN transistor and with the anode of said diode, its base electrode arranged to receive a select signal from an external source, and its emitter electrode electrically coupled with system ground.

16. A control system as set forth in claim 11 wherein said second driver means is comprised of a second driver circuit associated with each of said second electrodes wherein each second driver circuit includes positive coupling means for providing the positive components of said second voltage signal to the second electrode associated with the second driver circuit, negative coupling means for providing the negative components of said second voltage signal to the second electrode associated with the second driver circuit in response to a control signal and control signal producing means for providing a control signal to said negative coupling means in response to a select signal from an external source.

17. The control system as in claim 16 wherein said positive coupling means is comprised of a diode with its anode electrically coupled with said other output of said secondary winding and its cathode electrically coupled with the second electrode associated with the second driver circuit.

18. The control system as in claim 16 wherein said negative coupling means is comprised of a first PNP transistor with its collector and base electrodes electrically coupled with said other of said secondary windings and its emitter electrode electrically coupled with the second electrode associated with the second driver circuit.

19. A control system as set forth in claim 18 wherein said control signal producing means is comprised of a second PNP transistor having its emitter electrode arranged to receive a reference voltage signal, its base electrode arranged to receive a select signal from said external source and its collector electrode electrically coupled with the base electrode of said first PNP transistor.

20. A control system for energizing a gas discharge cell of a plasma display panel, said gas discharge cell being formed at the crossover point of an electrode and a second electrode, said control system comprising:

oscillator means for producing a first drive signal having an alternating sequence of positive and negative components respectively reaching a first predetermined positive voltage and a first predetermined negative voltage with said first predetermined positive voltage being equal to the absolute value of said first predetermined negative voltage and a second drive signal having an alternating sequence of positive and negative components respectively reaching a second predetermined positive voltage and a second predetermined negative voltage with said second predetermined positive voltage being equal to the absolute value of said second predetermined negative voltage wherein the positive components of said first drive signal substantially coincide with the negative components of said second drive signal and the negative components of said first drive signal substantially coincide with the positive components of said second drive signal;

first driver means for supplying to said first electrode the positive and negative components of said first drive signal whenever a first select signal is being received by said first driver means, said first driver means being further operable to supply to said first electrode only one of the components of said first drive signal if said first select signal is not being received by said first driver means; and second driver means for supplying to said second electrode the positive and negative components of said second drive signal whenever a second select signal is being received by said second driver means, said second driver means being further operable to supply to said second electrode only one of the components of said second drive signal if said second select signal is not being received by said second driver means.

21. A control system as set forth in claim 20 wherein said first driver means is comprised of means for applying the positive and negative components of said first voltage signal to said first electrode and means for inhibiting the application of one of the components of said first drive signal to the first electrode if said first select signal is not being received by said first driver means.

22. A control system as set forth in claim 21 wherein said inhibiting means is comprised of switch means for directing one of the components of said first drive signal to ground rather than to said first electrode if said first select signal is not being received by said segment driver means.

23. A control system as set forth in claim 20 wherein said second driver means is comprised of means for applying the positive and negative components of said second drive signal to said second electrode and means for inhibiting the application of one of the components of said second drive signal to the second electrode if said second select signal is not being received by said second driver means.

24. A control system as set forth in claim 23 wherein said inhibiting means is comprised of switch means for directing one of the components of said second drive signal to ground rather than to said second electrode if said second select signal is not being received by said second driver means.

25. A control system for energizing a gas discharge cell which is formed at the crossover point of a first electrode and a second electrode, said control system comprising:

oscillator means for producing a first drive signal having an alternating sequence of positive and negative components respectively reaching a first predetermined positive voltage and a first predetermined negative voltage with said first predetermined positive voltage being greater than the absolute value of said first predetermined negative voltage and a second drive signal having an alternating sequence of positive and negative components respectively reaching a second predetermined positive voltage and a second predetermined negative voltage with said second predetermined positive voltage being less than the absolute value of said second predetermined negative voltage wherein the positive components of said first drive signal coincide with the negative components of said second drive signal and the negative components of said first drive signal coincide with the positive components of said second drive signal;

first driver means for supplying to said first electrode the positive and negative components of said first drive signal whenever a first select signal is being received by said first driver means, said first driver means being further operable to supply to said first electrode only the negative components of said first drive signal if said first select signal is not being received by said first driver means; and second driver means for supplying to said second electrode the positive and negative components of said second drive signal whenever a second select signal is being received by said second driver means, said second driver means being further operable to supply to said second electrode only the positive components of said second drive signal if said second select signal is not being received by said second driver means.

26. A control system as set forth in claim 25 wherein said first driver means is comprised of means for applying the positive and negative components of said first drive signal to said first electrode and means for inhibiting the application of the positive components of said first drive signal to said first electrode if said first select signal is not being received by the first driver circuit.

27. A control system as set forth in claim 26 wherein said inhibiting means is comprised of switch means for directing the positive components of said first drive signal to ground rather than to the first electrode if said first select signal is not being received by the first driver circuit.

28. A control system as set forth in claim 25 wherein said second driver means is comprised of means for providing the positive components of said second drive signal to said second electrode, means for providing the negative components of said second drive signal to said second electrode in response to a control signal and means for providing a control signal to said signal control means in response to said second select signal.

29. A method for driving a plasma display panel having a plurality of first electrodes extending in a first direction and a plurality of second electrodes extending in a second direction wherein said first electrodes are maintained in a spaced-apart relationship from said second electrodes to form a gas discharge cell at each point where one of said first electrodes crosses over one of said second electrodes, said method comprising the steps of generating a first drive signal having an alternating sequence of positive and negative components respectively reaching a first predetermined positive voltage and a first predetermined negative voltage, generating a second drive signal having an alternating sequence of positive and negative components respectively reaching a second predetermined positive voltage and a second predetermined negative voltage wherein the positive components of said first drive signal coincide with the negative components of said second drive signal and the negative components of said first drive signal coincide with the positive components of said second drive signal, selectively applying the positive and negative components of said first drive signal to said first electrodes, and selectively applying the positive and negative components of said second drive signal to said second electrodes.

30. The method as in claim 29 wherein said step of selectively applying the positive and negative components of said first drive signal to said first electrodes comprises the steps of continuously applying one of the components of said first drive signal to each of the first electrodes, and periodically applying the other component of said first drive signal to each of the first electrodes in a set succession.

31. The method as in claim 30 wherein said step of selectively applying the positive and negative components of said second drive signal to said second electrodes comprises the steps of continuously applying one of the components of said second drive signal to each of the second electrodes, and selectively applying the other components of said second drive signal to the second electrodes in accordance with which of the first electrodes is presently receiving both of the components of said first drive signal.

32. In a plasma display panel having a plurality of first electrodes extending in a first direction and a plurality of second electrodes extending in a second direction wherein said first electrodes are maintained in a spaced-apart relationship from said second electrodes to form a gas discharge cell at each point where one of said first electrodes crosses over one of said second electrodes, a method for energizing a particular discharge cell of the panel, said method comprising the steps of generating a first drive signal having an alternating sequence of positive and negative components respectively reaching a first predetermined positive voltage and a first predetermined negative voltage with said first predetermined positive voltage being equal to the absolute value of said first predetermined negative voltage, generating a second drive signal having an alternating sequence of positive and negative components respectively reaching a second predetermined positive voltage and a second predetermined negative voltage with said second predetermined positive voltage being equal to the absolute value of said second predetermined negative voltage wherein the positive components of said first drive signal coincide with the negative components of said second drive signal and the negative components of said first drive signal coincide with the positive components of said second drive signal, applying the positive and negative components of said first drive signal to the first electrode associated with said particular discharge cell, and applying the positive and negative components of said second drive signal to said second electrode associated with said particular discharge cell.

33. The method as in claim 32 including the steps of applying only one of the components of said first drive signal to each of the first electrodes which are not associated with said particular discharge cell.

34. The method as in claim 32 including the steps of applying only one of the components of said second drive signal to each of the second electrodes which is not associated with said particular discharge cell.

35. In a plasma display panel having a plurality of first electrodes extending in a first direction and a plurality of second electrodes extending in a second direction wherein said first electrodes are maintained in a spaced-apart relationship from said second electrodes to form a gas discharge cell at each point where one of said first electrodes crosses over one of said second electrodes, a method for energizing a particular discharge cell of the panel, said method comprising the steps of:

generating a first drive signal having an alternating sequence of positive and negative components respectively reaching a first predetermined positive voltage and a first predetermined negative voltage with said first predetermined positive voltage being greater than the absolute value of said first predetermined negative voltage, generating a second drive signal having an alternating sequence of positive and negative components respectively reaching a second predetermined positive voltage and a second predetermined negative voltage with said second predetermined positive voltage being less than the absolute value of said second predetermined negative voltage wherein the positive components of said first drive signal coincide with the negative components of said second drive signal and the negative components of said first drive signal coincide with the positive components of said second drive signal, applying the positive and negative components of said first drive signal to the first electrode associated with said particular discharge cell, and applying the positive and negative components of said second drive signal to the second electrode associated with said particular discharge cell.

36. The method as in claim 35 including the steps of applying the negative components of said first drive signal to each of the first electrodes which is not associated with said particular discharge cell.

37. The method as in claim 35 including the step of only applying the positive components of said second drive signal to each of the second electrodes which is not associated with said particular discharge cell.

* * * * *